US011781570B2

(12) United States Patent
Michaud et al.

(10) Patent No.: US 11,781,570 B2
(45) Date of Patent: Oct. 10, 2023

(54) PNEUMATIC REMOTE ACTUATING DEVICE

(71) Applicant: ERDAN INC., Sainte-Anne-de-la-Rochelle (CA)

(72) Inventors: Steeve Michaud, Sherbrooke (CA); Benoit Langlois, Sainte-Catherine-de-Hatley (CA); Rene Bosa, St-Georges de Beauce (CA); Jacky Lessard, Notre-Dame-de-l'lle-Perrot (CA); Carl Sylvain, Sainte-Anne-de-la-Rochelle (CA)

(73) Assignee: ERDAN INC., Sainte-Anne-de-la-Rochelle (CA)

( * ) Notice: Subject to any disclaimer, the term of this patent is extended or adjusted under 35 U.S.C. 154(b) by 0 days.

(21) Appl. No.: 17/914,032

(22) PCT Filed: Mar. 25, 2021

(86) PCT No.: PCT/CA2021/050386
§ 371 (c)(1),
(2) Date: Sep. 23, 2022

(87) PCT Pub. No.: WO2021/189142
PCT Pub. Date: Sep. 30, 2021

(65) Prior Publication Data

US 2023/0137001 A1 May 4, 2023

Related U.S. Application Data

(60) Provisional application No. 63/012,546, filed on Apr. 20, 2020, provisional application No. 63/000,797, filed on Mar. 27, 2020.

(51) Int. Cl.
*F15B 15/10* (2006.01)
*F15B 15/02* (2006.01)

(52) U.S. Cl.
CPC ..... *F15B 15/10* (2013.01); *F15B 15/02* (2013.01); *F15B 2211/8855* (2013.01)

(58) Field of Classification Search
CPC .... F15B 7/00; F15B 7/06; F15B 15/02; F15B 15/10; F15B 2211/8855; G05G 1/02; B66B 1/14; B66B 1/50
See application file for complete search history.

(56) References Cited

U.S. PATENT DOCUMENTS 3,710,571 A * 1/1973 Tracey ..... H01H 3/24 200/83 B
4,413,214 A 11/1983 Brown
(Continued)

FOREIGN PATENT DOCUMENTS

CN 202181151 U 4/2012
EP 0266242 A1 5/1988
(Continued)

OTHER PUBLICATIONS

PCWorld—The Push by Naran is a connected home . . . finger. Youtube [online] [video]. PCWorld, Jan. 7, 2016, retrieved on 2021-05-271 from <https://www.youtube.com/watch?v=-Px73eACUal&list=RDCMUCDC1PaslaocEA5HB17jp0ew&start_radio=1&rv=-Px73eACUal>.
(Continued)

*Primary Examiner* — Thomas E Lazo
(74) *Attorney, Agent, or Firm* — BCF LLP

(57) ABSTRACT

A pneumatic remote actuating device includes an actuator block, an actuated block and a tube connecting the actuator block to the actuated block. The actuator block includes an enclosure that can be mounted on a generally flat surface. A pushbutton protrudes in front of the actuator block. Depressing the pushbutton causes an increase of pressure within an internal chamber of the enclosure. This pressure is transmitted from the actuator block, via the tube, to the actuated
(Continued)

block. The actuated block comprises its own enclosure that can be mounted on a generally flat surface to place the actuated block in an overlapping position over an external pushbutton. The pressure transmitted from the actuator block to the actuated block causes a displacement of a pusher mounted in the enclosure of the actuated block. As a result, the pusher actuates the external pushbutton.

16 Claims, 24 Drawing Sheets

(56) References Cited

U.S. PATENT DOCUMENTS

| | | | | |
|---|---|---|---|---|
| 4,754,107 | A * | 6/1988 | Tracey | H01H 3/24 200/83 Z |
| 4,918,920 | A * | 4/1990 | Duroux | B60Q 1/064 60/591 |
| 5,861,870 | A * | 1/1999 | Anderson | G06F 3/039 345/157 |
| 5,962,826 | A | 10/1999 | Bassin | |
| 8,220,260 | B2 * | 7/2012 | Harris | A63H 13/00 60/533 |
| 2006/0180407 | A1 * | 8/2006 | Lee | B66B 1/467 187/380 |

FOREIGN PATENT DOCUMENTS

| | | | |
|---|---|---|---|
| EP | 1931882 | A1 | 6/2008 |
| FR | 2463303 | A1 | 2/1981 |
| GB | 2079376 | A | 1/1982 |
| GB | 2107406 | A | 4/1983 |

OTHER PUBLICATIONS

International Search Report of PCT/CA2021/050386; Benoist Henrot; dated Jun. 2, 2021.

* cited by examiner

PNEUMATIC REMOTE ACTUATING DEVICE

CROSS-REFERENCE

The present application claims priority from U.S. Provisional Application No. 63/000,797, filed on Mar. 27, 2020, and from U.S. Provisional Application No. 63/012,546, filed on Apr. 20, 2020, the entirety of both of which is incorporated by reference herein.

TECHNICAL FIELD

The present disclosure relates to the field of actuating devices. More specifically, the present disclosure relates to a pneumatic remote actuating device.

BACKGROUND

Our world is filled with a myriad of actuating devices, for example pushbuttons, that are used to initiate operation of various machines, electronic devices, apparatuses, and the like. Some machines and apparatuses may be put in operation by actuation of a single pushbutton; as an example, some doors can be opened manually in a normal manner, or electrically by actuation of a pushbutton accessible to persons having various disabilities. Other machines and apparatuses may be operated by action of a number of pushbuttons; as an example, an elevator may be called to a floor by use of a pair of buttons for going up or down, a plurality of pushbuttons being accessible inside the elevator for selecting one of a plurality of floors.

Many of these pushbuttons can be pressed by users using their fingers. Unfortunately, pushbuttons may become hosts to a variety of germs, viruses and bacteria, and become vectors for contamination. This is a particularly severe issue during the COVID-19 pandemic of early 2020. Other problems related to conventional actuating devices include the difficulty for persons with some disabilities to use them as designed.

Many machines and apparatuses and designed to operate with conventional electronic remote controls. Other machines and apparatuses can be retrofitted to operate with electronic remote controls. However, retrofitting existing equipment may be time consuming and cost prohibitive.

Therefore, there is a need for improvements that compensate for problems related to the lack of hygiene of conventional actuating devices and to the difficulties in retrofitting existing equipment with electronic remote controls.

SUMMARY

According to the present disclosure, there is provided a pneumatic remote actuating device, comprising:

a tube;

an actuator block comprising:

a first enclosure defining a first compressible internal chamber fluidly connected to the tube, compressing the first compressible internal chamber causing an air pressure variation in the first internal chamber, the air pressure variation being transmitted from the first enclosure to the tube; and an actuated block, comprising:

a second enclosure defining a second internal chamber fluidly connected to the tube, the air pressure variation being transmitted from the tube to the second internal chamber, and a pusher mounted to the second enclosure, the air pressure variation transmitted by the tube to the second internal chamber causing a displacement of the pusher.

In some implementations of the present technology, the actuator block further comprises a pushbutton slidably mounted to the first enclosure, wherein an inward movement of the pushbutton from a resting position to an activated position into the first enclosure compresses the first compressible internal chamber and causes the air pressure variation in the first internal chamber.

In some implementations of the present technology, at least one of the actuator block and the actuated block includes a leak allowing a reduction of the air pressure variation when the pushbutton returns to the resting position.

In some implementations of the present technology, the tube is selected from a flexible tube and a rigid tube.

In some implementations of the present technology, the second enclosure of the actuated block includes a generally flat rear face adapted to be bonded to a receiving surface; and the displacement of the pusher extends from the generally flat rear face of the second enclosure.

In some implementations of the present technology, the first enclosure of the actuator block includes a generally flat rear face adapted to be bonded to a receiving surface; and an external face of the pushbutton extends away from the generally flat rear face of the first enclosure when in the resting position.

In some implementations of the present technology, the pushbutton is adapted to be foot-operated.

In some implementations of the present technology, the biasing element is located within the first enclosure and is positioned to be compressed when the pushbutton is moved from the resting position to the activated position.

In some implementations of the present technology, the biasing element comprises a coil spring.

In some implementations of the present technology, the pusher is unbiased.

In some implementations of the present technology, applying an external pressure on the pushbutton causes the inward movement of the pushbutton from a resting position to an activated position.

In some implementations of the present technology, the actuator block further comprises a biasing element adapted to cause the pushbutton to return to the resting position when no external pressure is applied on the pushbutton.

In some implementations of the present technology, the actuator block further comprises a first channel formed in the first enclosure, the first channel fluidly connecting the first internal channel to the tube to transmit the air pressure variation from the first enclosure to the tube.

In some implementations of the present technology, the actuated block further comprises a second channel formed in the second enclosure, a first end of the second channel fluidly connecting the tube to the second internal chamber to transmit the air pressure variation from the tube to the second internal chamber, the pusher being positioned at a second end of the second channel so that the air pressure variation transmitted by the tube to the second internal chamber causes the displacement of the pusher.

In some implementations of the present technology, the pusher is slidably mounted to the second enclosure, the pusher having a resting position and an activated position, the displacement of the pusher being obtained when the air pressure variation transmitted by the tube to the second internal chamber causes the pusher to move from the resting position to the activated position.

In some implementations of the present technology, the activated block comprises a pivot, the pusher being supported by the pivot, the displacement of the pusher being obtained when the air pressure variation transmitted by the tube to the second internal chamber causes pivoting of the pusher.

In some implementations of the present technology, the actuator block further comprises a first diaphragm fluidly connected to the first internal chamber, the inward movement of the pushbutton in the first enclosure causing a deflection of the first diaphragm and, in turn, causing the air pressure variation in the first internal chamber.

In some implementations of the present technology, the actuated block further comprises a second diaphragm fluidly connected to the second internal chamber, the air pressure variation transmitted by the tube to the second internal chamber causing a deflection of the diaphragm and, in turn, causing the displacement of the pusher.

In some implementations of the present technology, the air pressure variation is a variation in relation to an ambient atmospheric pressure.

In some implementations of the present technology, the air pressure variation is an increase of air pressure.

In some implementations of the present technology, the air pressure variation is a decrease of air pressure.

According to the present disclosure, there is also provided a pair of pneumatic remote actuating devices. A first actuated block of a first pneumatic remote actuating device is operable to cause a rocker switch to move from a first to a second position. A second actuated block of a second pneumatic remote actuating device is operable to cause the rocker switch to move from the second to the first position.

The present disclosure further provides a set comprising a plurality of pneumatic remote actuating devices. Each pusher of the set is operable to cause activation of a corresponding elevator button.

The foregoing and other features will become more apparent upon reading of the following non-restrictive description of illustrative embodiments thereof, given by way of example only with reference to the accompanying drawings.

BRIEF DESCRIPTION OF THE DRAWINGS

Embodiments of the disclosure will be described by way of example only with reference to the accompanying drawings, in which.

Like numerals represent like features on the various drawings.

DETAILED DESCRIPTION

Figure 1:
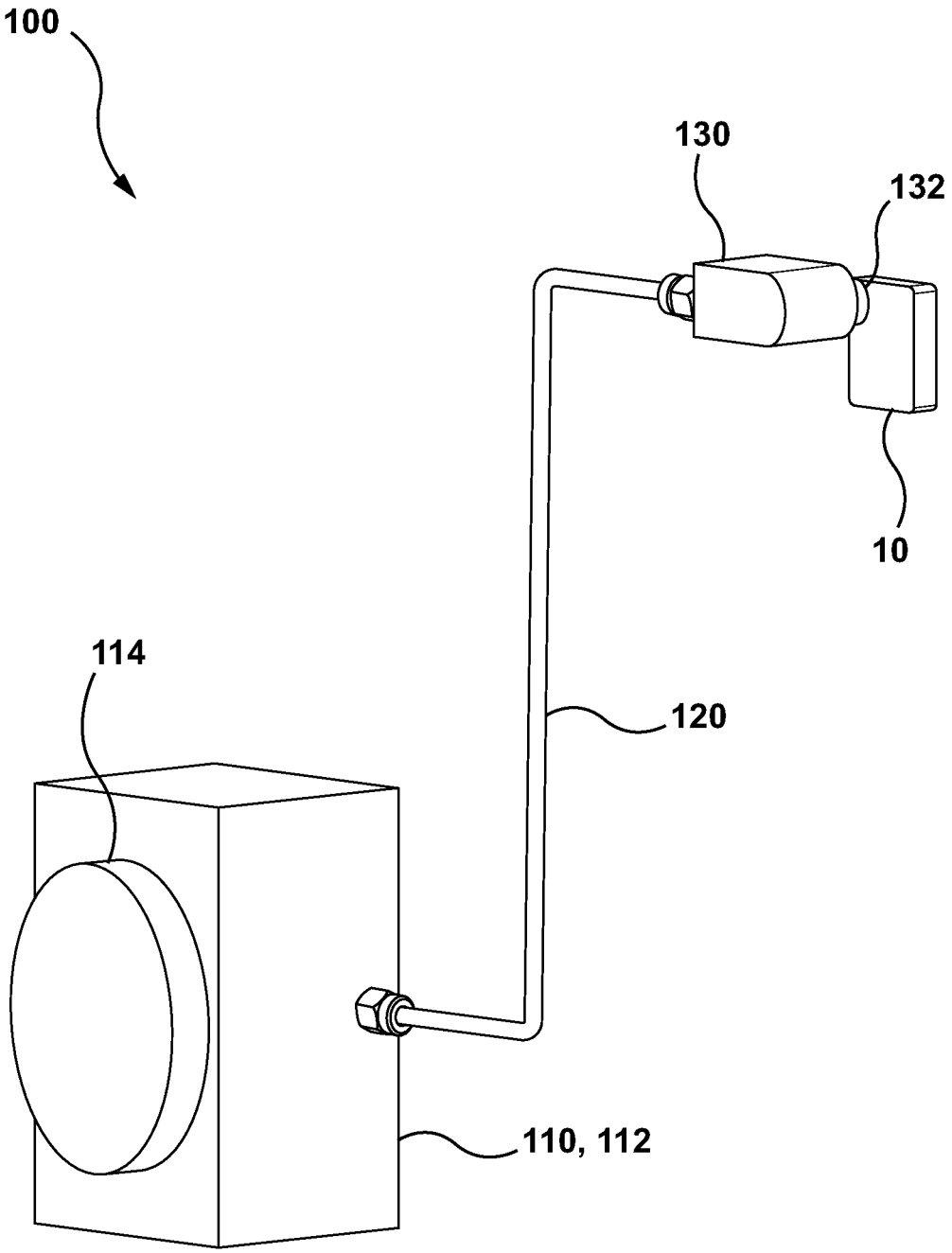
FIG. 1 is an illustrative block diagram of a pneumatic remote actuating device according to an embodiment.

Various aspects of the present disclosure generally address one or more of the problems of the lack of hygiene of conventional actuating devices and to the difficulties in retrofitting existing equipment with electronic remote controls.

The present technology introduces a pneumatic remote actuating device that includes an actuator block, an actuated block and a tube connecting the actuator block to the actuated block. As viewed externally, the actuator block includes an enclosure that can be mounted on a generally flat surface, for example and without limitation using a double side adhesive tape to mount the actuator block, for example on a lower part of a wall or on a floor. A pushbutton protrudes in front of the actuator block. Depressing the pushbutton causes an air pressure variation (either an increase of air pressure or a vacuum) within an internal chamber contained in the enclosure. This air pressure variation is transmitted from the actuator block, via the tube, to the actuated block. The actuated block comprises its own enclosure that can be mounted on a generally flat surface, for example and without limitation using a double side adhesive tape, to place the actuated block in an overlapping position over an external pushbutton to be activated. The air pressure variation transmitted from the actuator block to the actuated block causes an displacement of a pusher mounted in the enclosure of the actuated block. As a result, the pusher presses on the external pushbutton.

In an embodiment, when the pushbutton of the actuator block is released, it returns to a resting position, for example by action of a biasing element such as a coil spring. This action tends to reduce the air pressure variation throughout the pneumatic remote actuating device, facilitating a return of the pusher to its own resting position. In many cases, the external pushbutton will also include its own biasing means that will further facilitate the return of the pusher to its resting position.

In a use case, the external pushbutton, which would normally be depressed by a finger of a user, is thus actuated by action of a foot of the user on the pushbutton of the actuator block and on the resulting pressure applied on the pusher. In this manner, both hands of the user may remain free, for example for holding bags, a box, and the like. The user may also avoid touching the external pushbutton with fingers, particularly when there is a reason to be concerned about the presence of germs, bacteria, or viruses on the external pushbutton. The pushbutton of the actuator block may also be pushed by the foot of a child who is not sufficiently tall to reach the external pushbutton.

In an embodiment, the pusher may be mounted on a pivot within the enclosure of the actuated block. In a non-limiting use case of this embodiment, two pneumatic remote actuating devices may be used to operate a rocker switch such as those that are commonly used to turn on and off residential lighting. A first pivoting pusher of a first pneumatic remote actuating device may be used to move the rocker switch from a first position to a second position, for example to turn on the lights. A second pivoting pusher of a second pneumatic remote actuating device may be used to move the rocker switch from the second position to the first position, for example to turn off the lights.

In another embodiment, a set comprising a plurality of pneumatic remote actuating devices may be assembled to control a plurality of corresponding external pushbuttons. In a non-limiting use case, such a set may be used to operate a number of pushbuttons of an elevator. For example, in a hospital where sanitary conditions are important, it becomes possible to select a floor or to cause opening and closing of the doors without touching any of the conventional external pushbuttons of the elevator with one's fingers.

In the same or other embodiments, the actuated block and the pusher may be sized and configured to apply pressure on an external pushbutton while leaving a sufficiently large area of the external pushbutton to allow conventional actuation with fingers of a user.

The present technology may be used in many more use cases, for example in industrial, commercial, transport or residential applications. One or more pneumatic remote actuating devices may be installed within a few minutes, using for example double side adhesive tape to mount the actuator and actuated blocks in desired positions. Use of magnets to mount the actuator and/or the actuated blocks on a metallic surface is also contemplated. The pneumatic remote actuating devices may be installed on a temporary basis. Alternatively, for more permanent uses, the actuator and actuated blocks may be mounted in desired positions using glue, screws, and the like, also using ordinary tools. The pneumatic remote actuating devices may also be dismounted by hand or using ordinary tools. In the particular case of a set comprising a plurality of pneumatic remote actuating devices, the actuator blocks may be mounted on a track and the actuated blocks may be mounted on another track. In turn, the tracks may be temporarily or permanently affixed on receiving surfaces. No modification of existing installations is required in most circumstances. The present technology does not require any electrical power or wiring.

Referring now to the drawings, FIG. 1 is an illustrative block diagram of a pneumatic remote actuating device according to an embodiment. A pneumatic remote actuating device 100 is used to operate an external pushbutton 10. The pneumatic remote actuating device 100 includes an actuator block 110 having an enclosure 112. A pushbutton 114 protrudes from the enclosure 112. Without limitation, the enclosure 112 and the pushbutton 114 may be made of a sturdy construction to be repeatedly actuated by the feet of users. The actuator block 110 is connected to an actuated block 130 via a tube 120, for example a flexible tube. It is also contemplated that the actuator block 110 and the actuated block 130 may be connected via a rigid tube. The actuated block 130 is installed next to the external pushbutton so that a pusher 132 of the actuated block 130 overlaps at least in part over the external pushbutton 10. Depressing the pushbutton 114 on the actuator block 110 causes an increase of air pressure within the enclosure 112. This air pressure variation is transmitted via the tube 120 to the actuated block 130, causing the pusher 132 to press on the external pushbutton 10. A different construction of the actuator block 110 and of the actuated block 130 may cause a decrease of air pressure (a vacuum) to be transmitted via the tube 120 from the actuator block 110 to the actuated block 130, also resulting in causing the pusher 132 to press on the external pushbutton 10. In an embodiment, pneumatic remote actuating device 100 may be operated at ambient atmospheric pressure, and the air pressure variation may be a variation in relation to the ambient atmospheric pressure.

Figure 2:
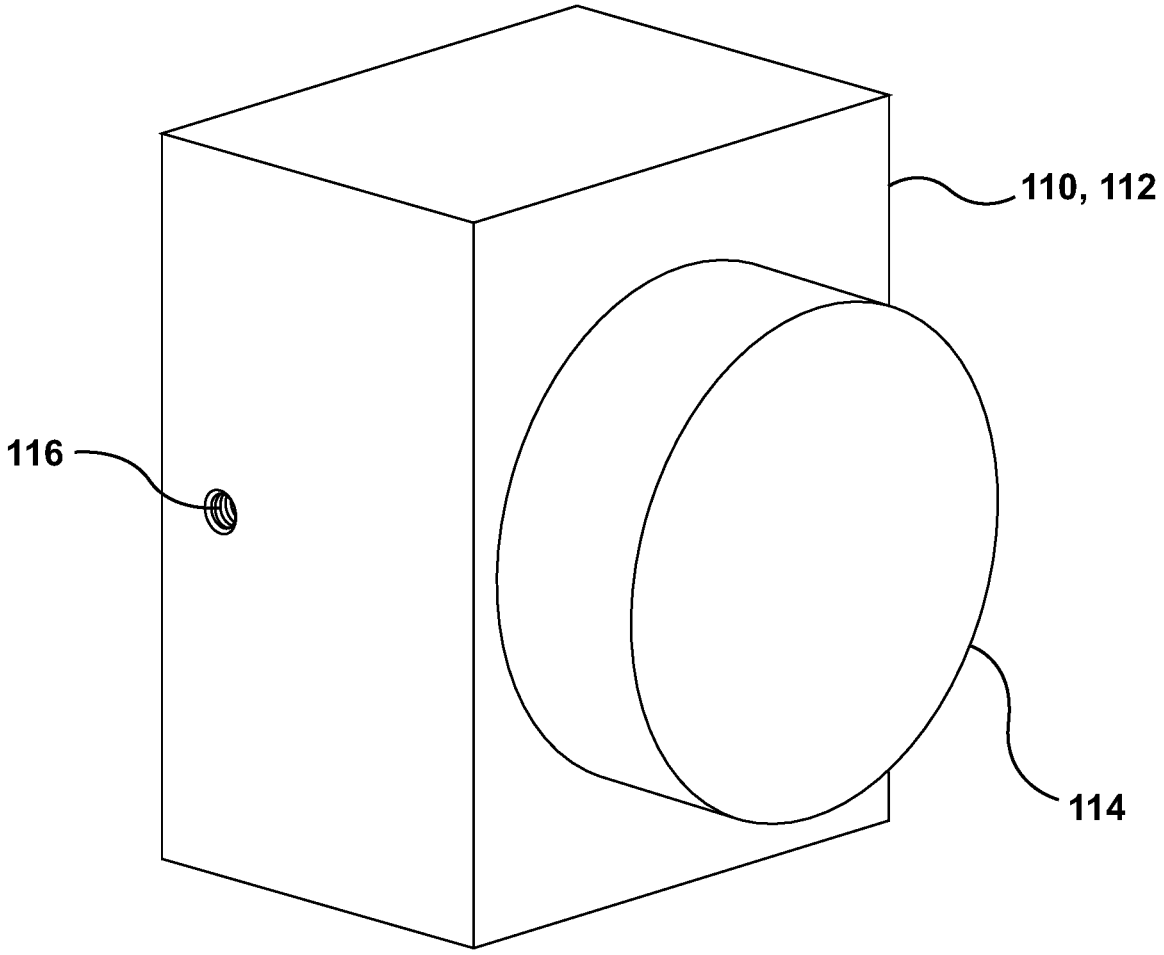
FIG. 2 is a perspective view of an actuator block of the pneumatic remote actuating device of FIG. 1.
Figure 3:
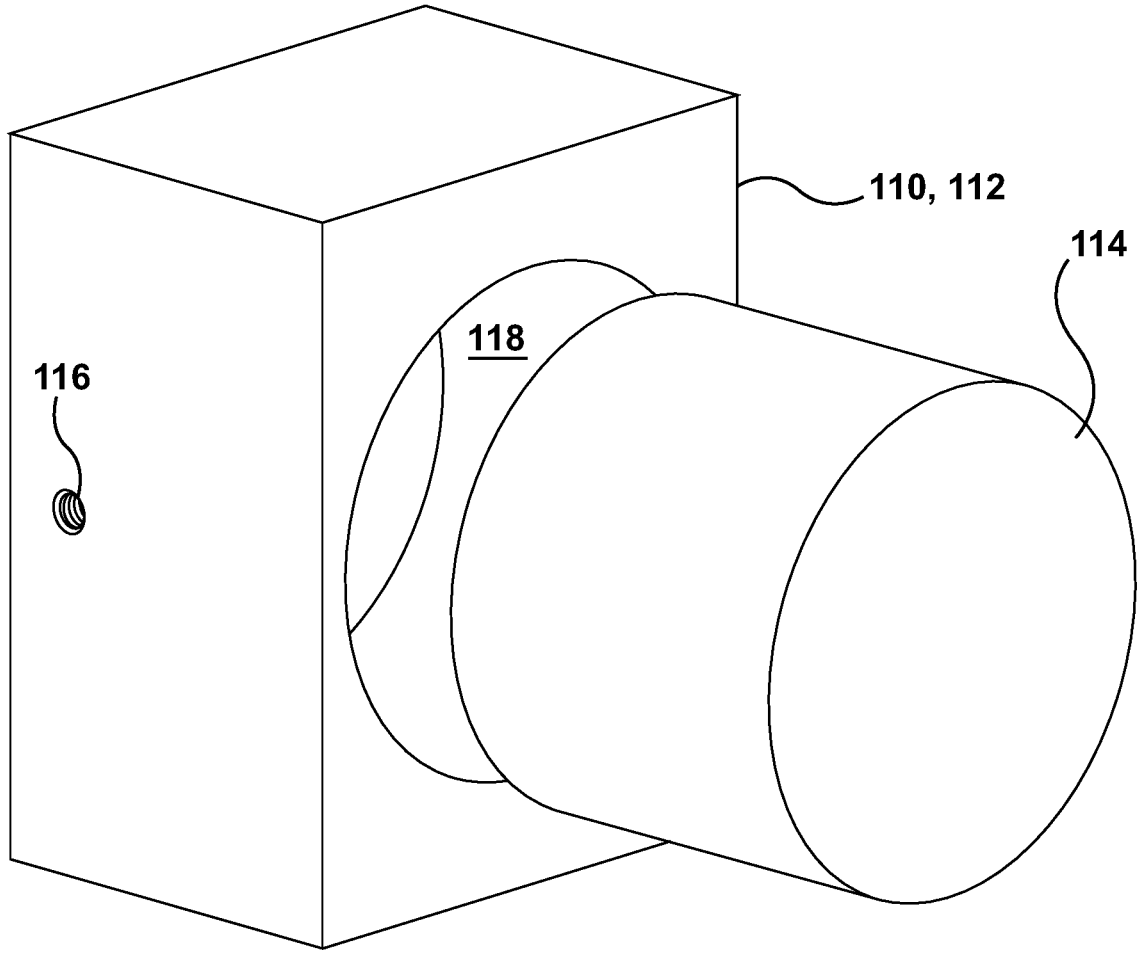
FIG. 3 is an exploded perspective view of the actuator block of FIG. 2.
Figure 4:
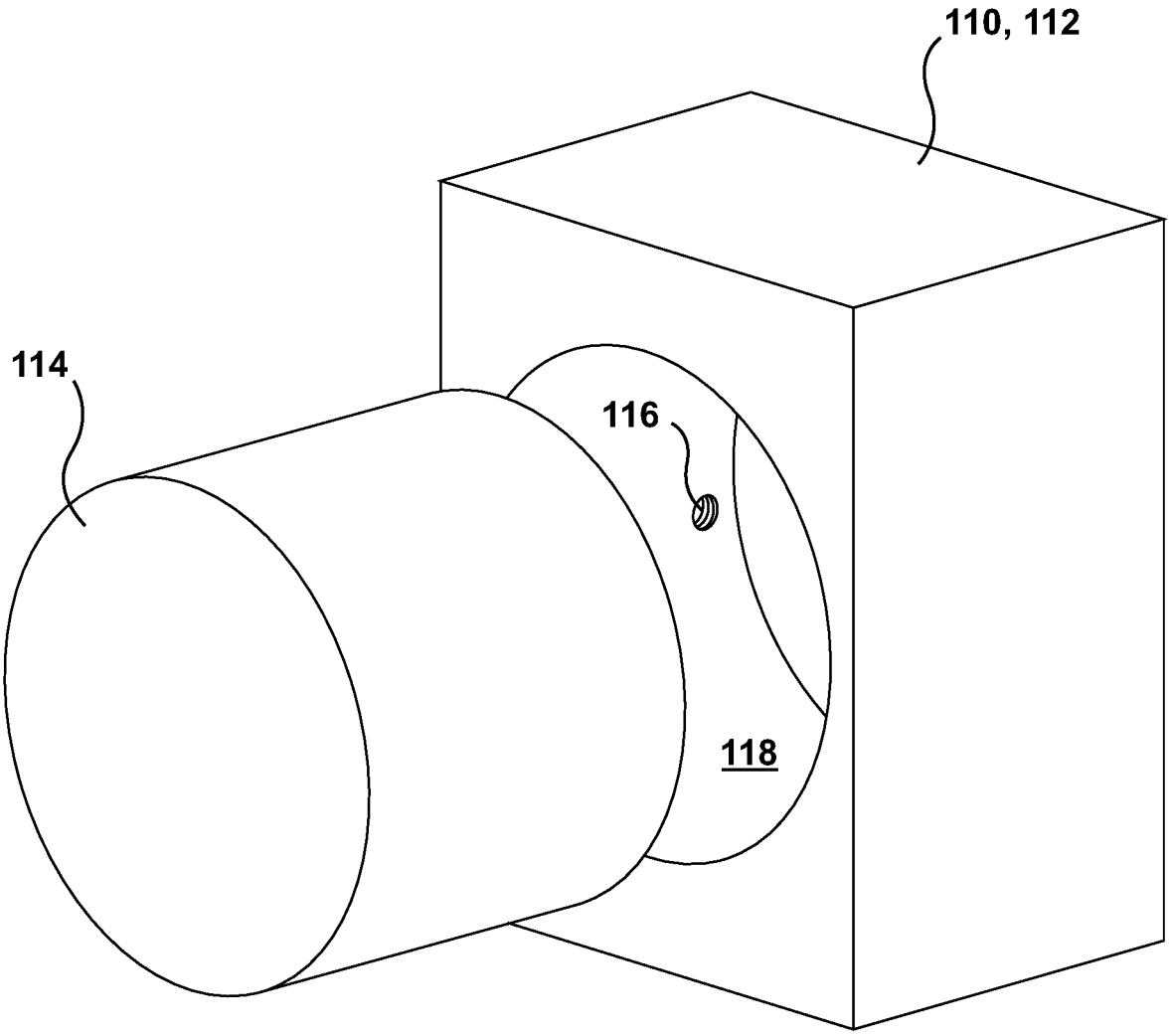
FIG. 4 is another exploded perspective view of the actuator block of FIG. 2.

FIG. 2 is a perspective view of an actuator block of the pneumatic remote actuating device of FIG. 1. FIG. 3 is an exploded perspective view of the actuator block of FIG. 2. FIG. 4 is another exploded perspective view of the actuator block of FIG. 2. Referring to FIGS. 2-4, a channel 116 is formed in an internal chamber 118 formed in the enclosure 112 of the actuator block 110 to provide a fluid connection between the internal chamber 118 and the tube 120. When an external pressure is applied on the pushbutton 114, the pushbutton 114 slides inward of the enclosure 112 and compresses the air present in the internal chamber 118, thereby causing the increase of pressure.

Although not shown various arrangements are provided to ensure that the pushbutton 114 is not dislodged from the actuator block 110 when no external pressure is applied thereon. These arrangements may include forming a lip on a back end of the pushbutton 114, the lip preventing removal of the pushbutton from the enclosure 112. Clips may also be used. The person of ordinary skill in the art will readily able to develop such arrangements.

Figure 5:
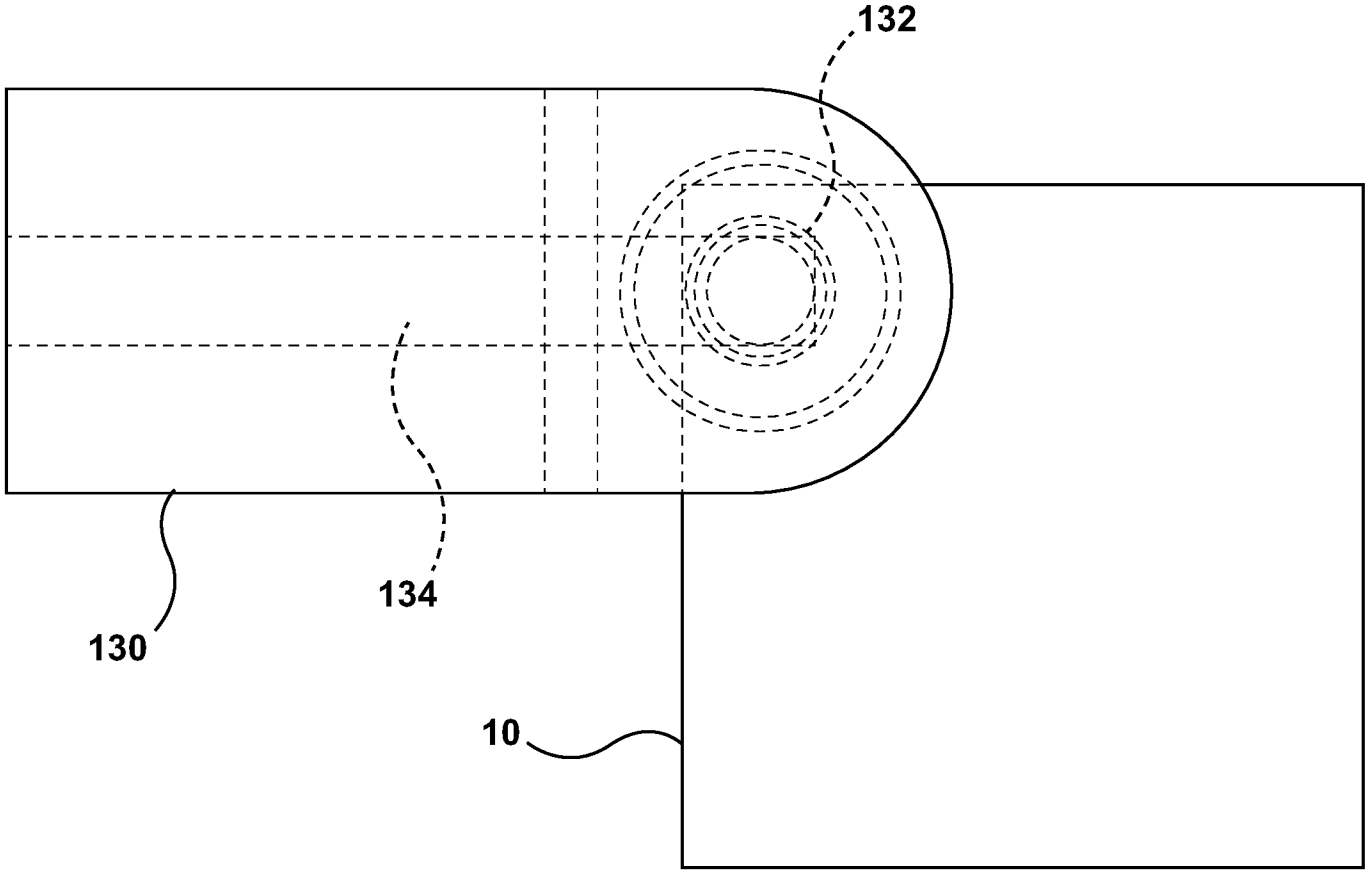
FIG. 5 is a front elevation view of an actuated block of the pneumatic remote actuating device of FIG. 1.
Figure 6:
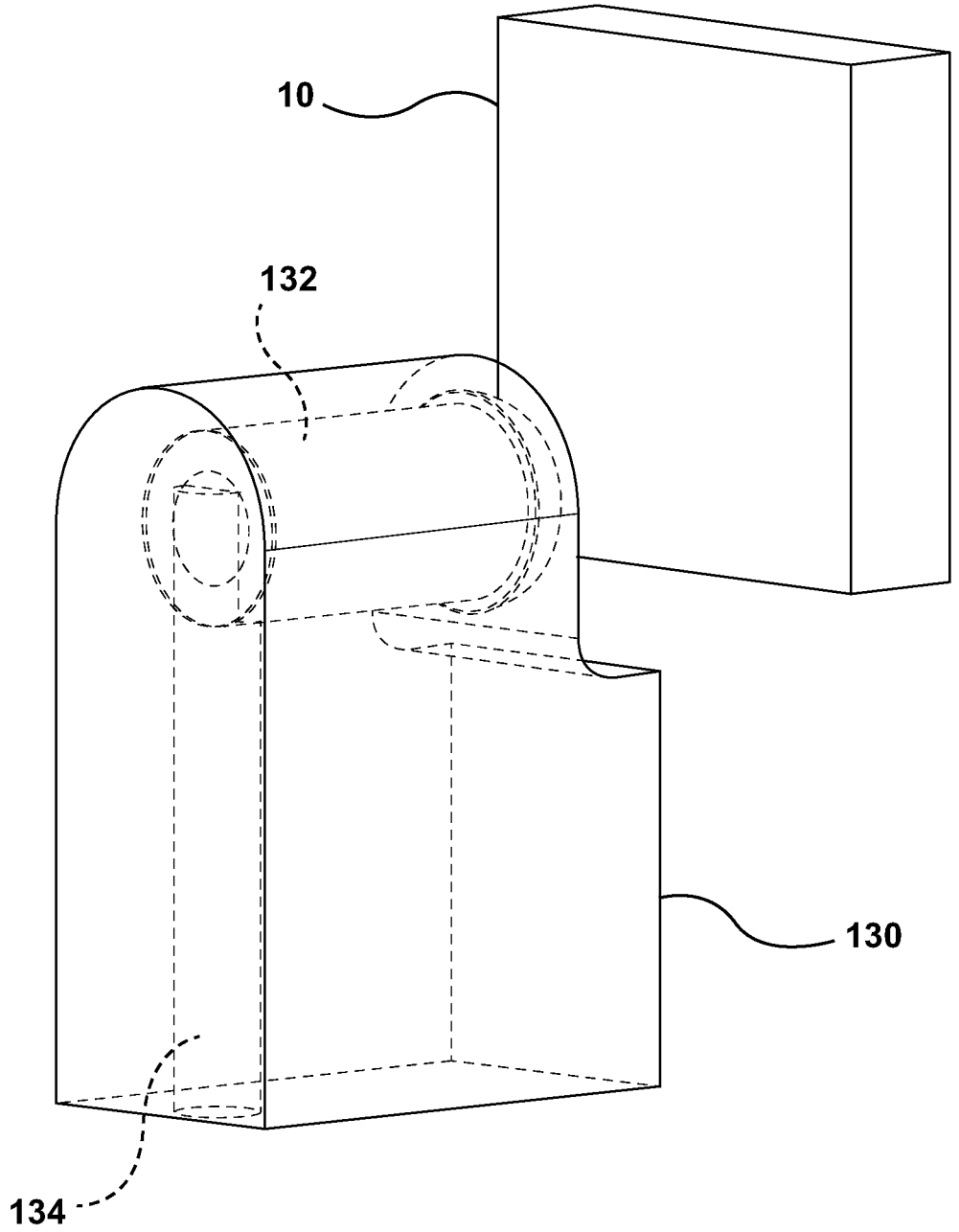
FIG. 6 is a perspective view of the actuated block of FIG. 5.

FIG. 5 is a front elevation view of an actuated block of the pneumatic remote actuating device of FIG. 1. FIG. 6 is a perspective view of the actuated block of FIG. 5. A channel 134 is formed in the actuated block 130. The tube 120 is connected to the actuated block 130 via an entry port of the channel 134. The pressure applied via the tube 120 reaches the channel 134 and causes a forward displacement of the pusher 132 that, in turn, applies pressure on the external pushbutton 10.

Figure 7:
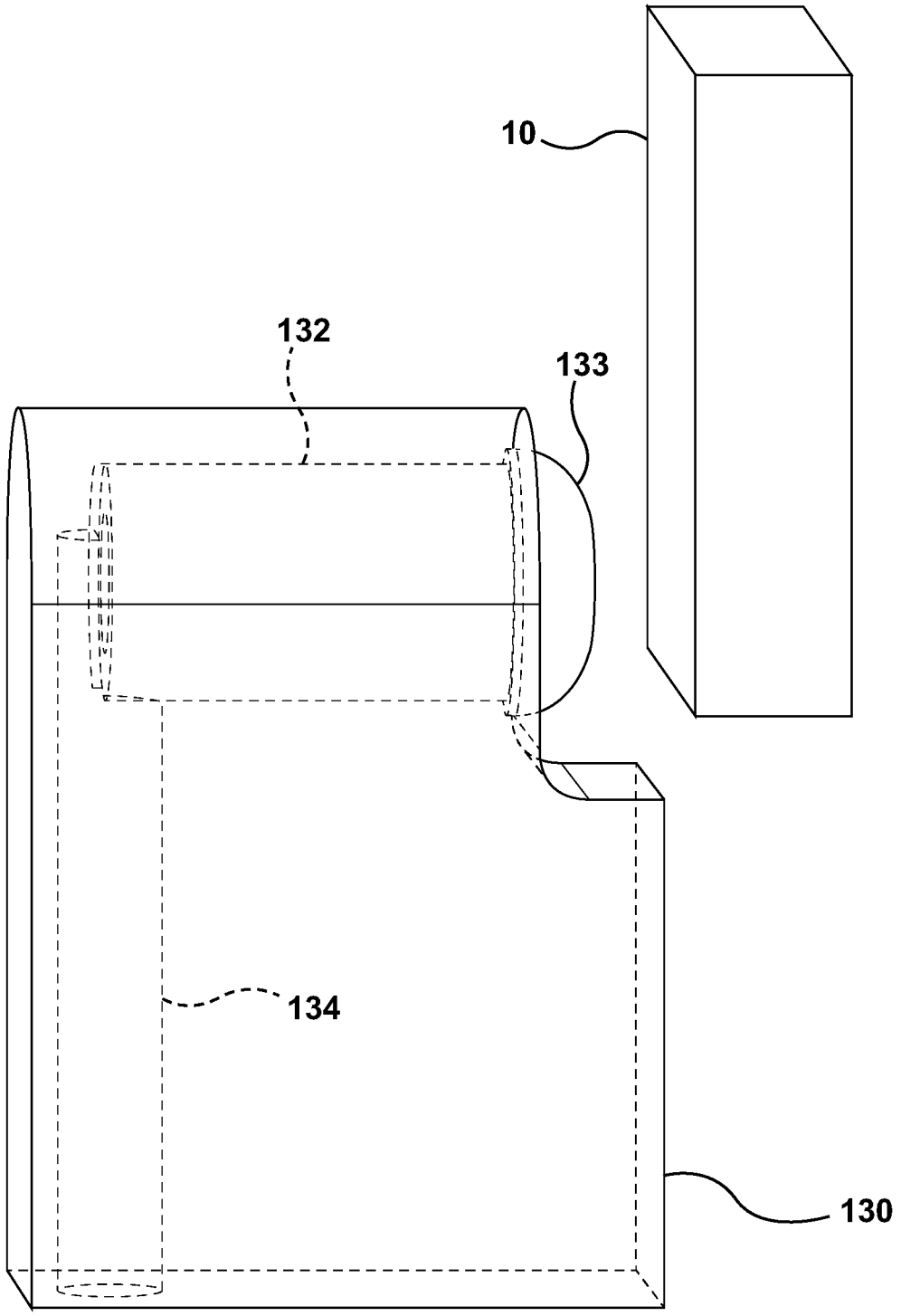
FIG. 7 is a side elevation view of the actuated block of FIG. 5 in a resting position.
Figure 8:
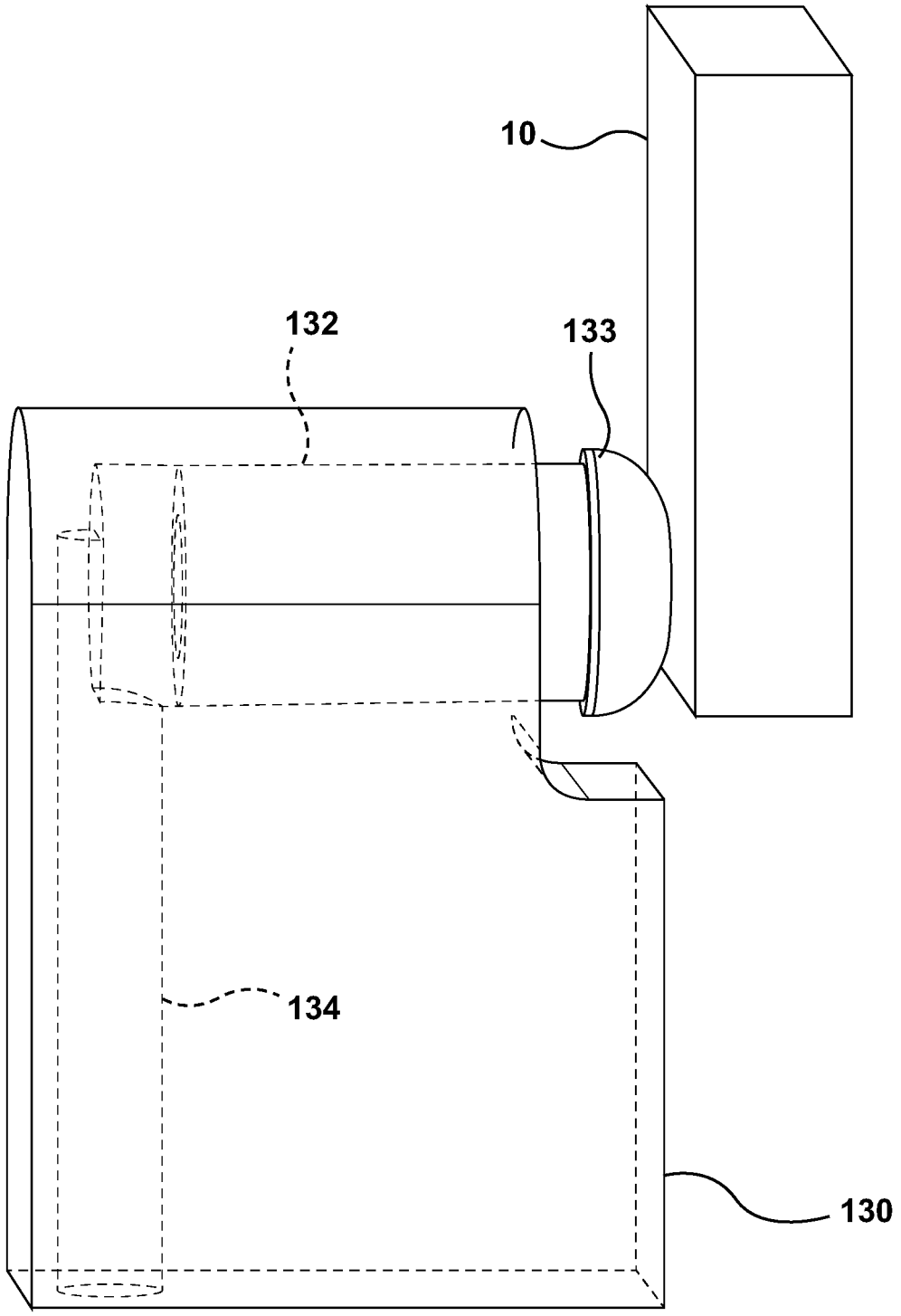
FIG. 8 is a side elevation view of the actuated block of FIG. 5 in an actuated position.

FIG. 7 is a side elevation view of the actuated block of FIG. 5 in a resting position. FIG. 8 is a side elevation view of the actuated block of FIG. 5 in an actuated position. In the embodiment of FIGS. 7 and 8, a cap 133, for example a rubber cap, is mounted on a tip of the pusher 132. When there is no excess pressure in the channel 134 (the channel 134 being generally at atmospheric pressure), the pusher 132 is in the resting position as shown on FIG. 7. Under an increase of pressure in the channel 134, the pusher 132 moves to its actuated position as shown on FIG. 8, pushing on the external pushbutton 10. Although FIG. 7 illustrates a space between the cap 133 and a surface of the external pushbutton 10, the actuated bock 130 may be sized and configured so that the cap 133 rests lightly on the pushbutton 10 when in the resting position. In most occurrences, the external pushbutton will be biased to return to its own resting position when not pressed; this action of the external pushbutton 10 may facilitate a return of the pusher 132 to its resting position when there is no excess pressure in the channel 134. In an embodiment, at least one of the actuator block 110 and the actuated block 130 may include a leak allowing a reduction of air pressure when the pushbutton returns to the resting position. In another embodiment, the entire pneumatic remote actuating device 100 may be fully sealed and devoid of any significant leak.

Figure 9:
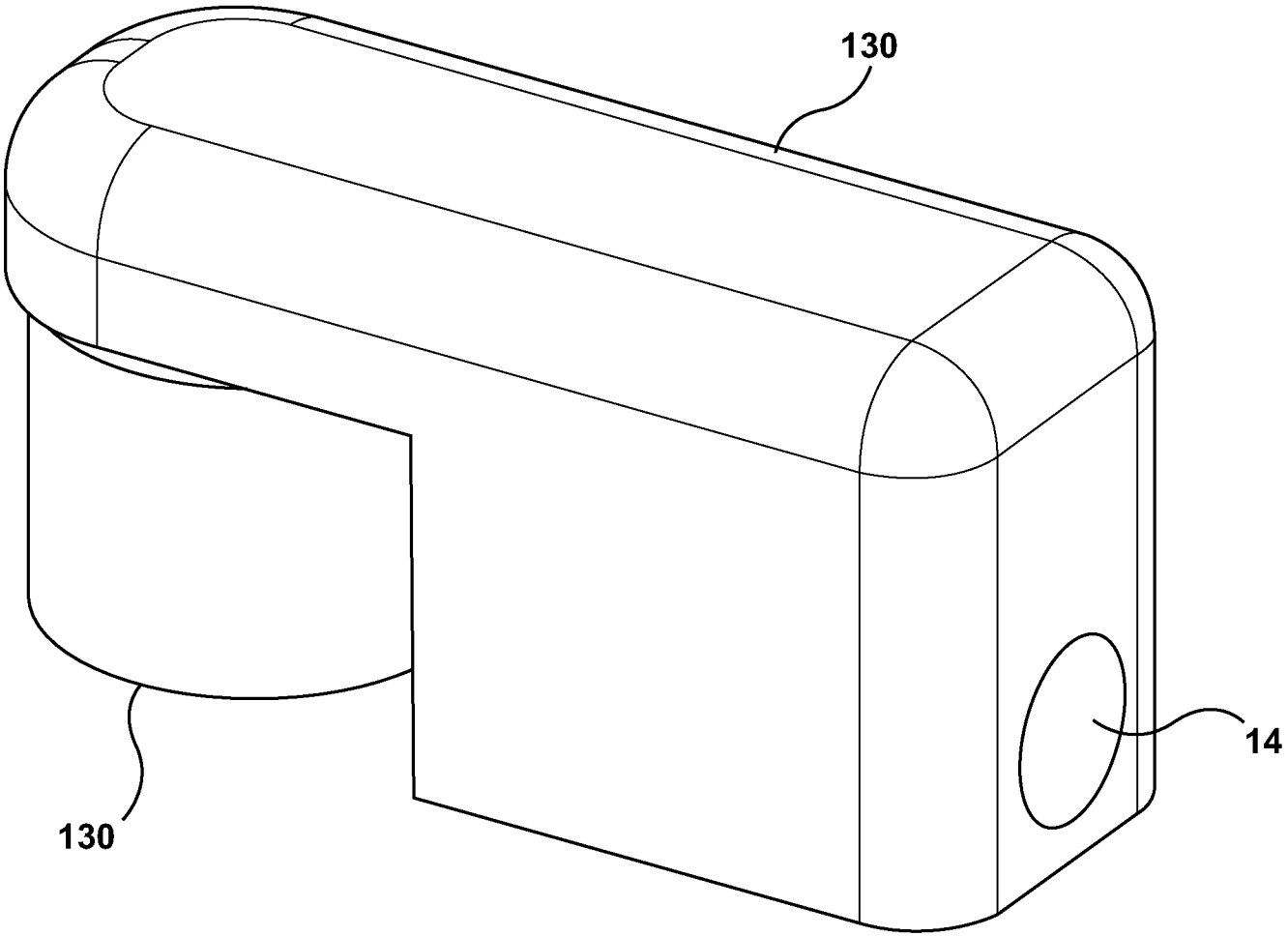
FIG. 9 is a perspective view of an actuated block of the pneumatic remote actuating device according to another embodiment.
Figure 10:
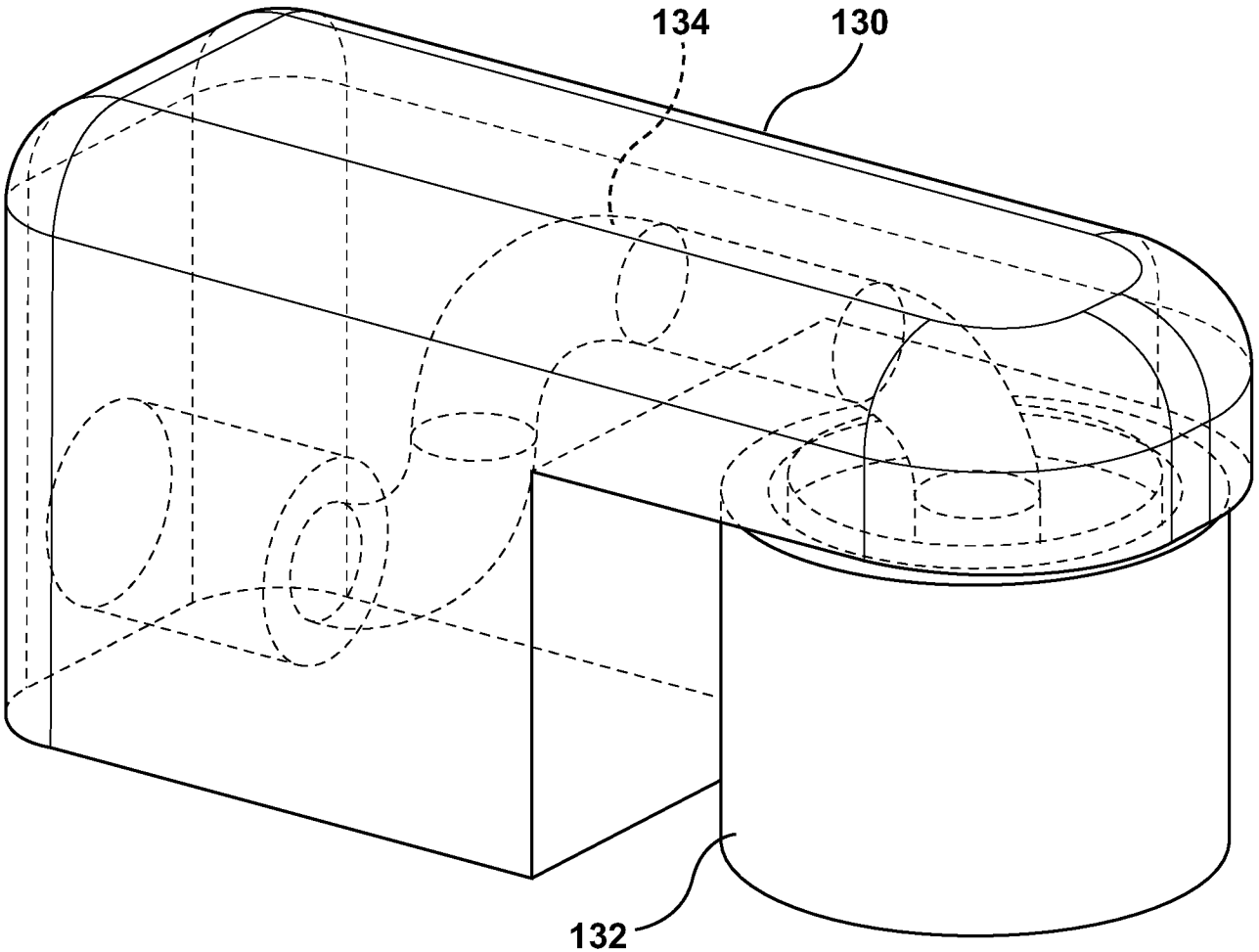
FIG. 10 is a transparent perspective view of the actuated block of the pneumatic remote actuating device of FIG. 9.
Figure 11:
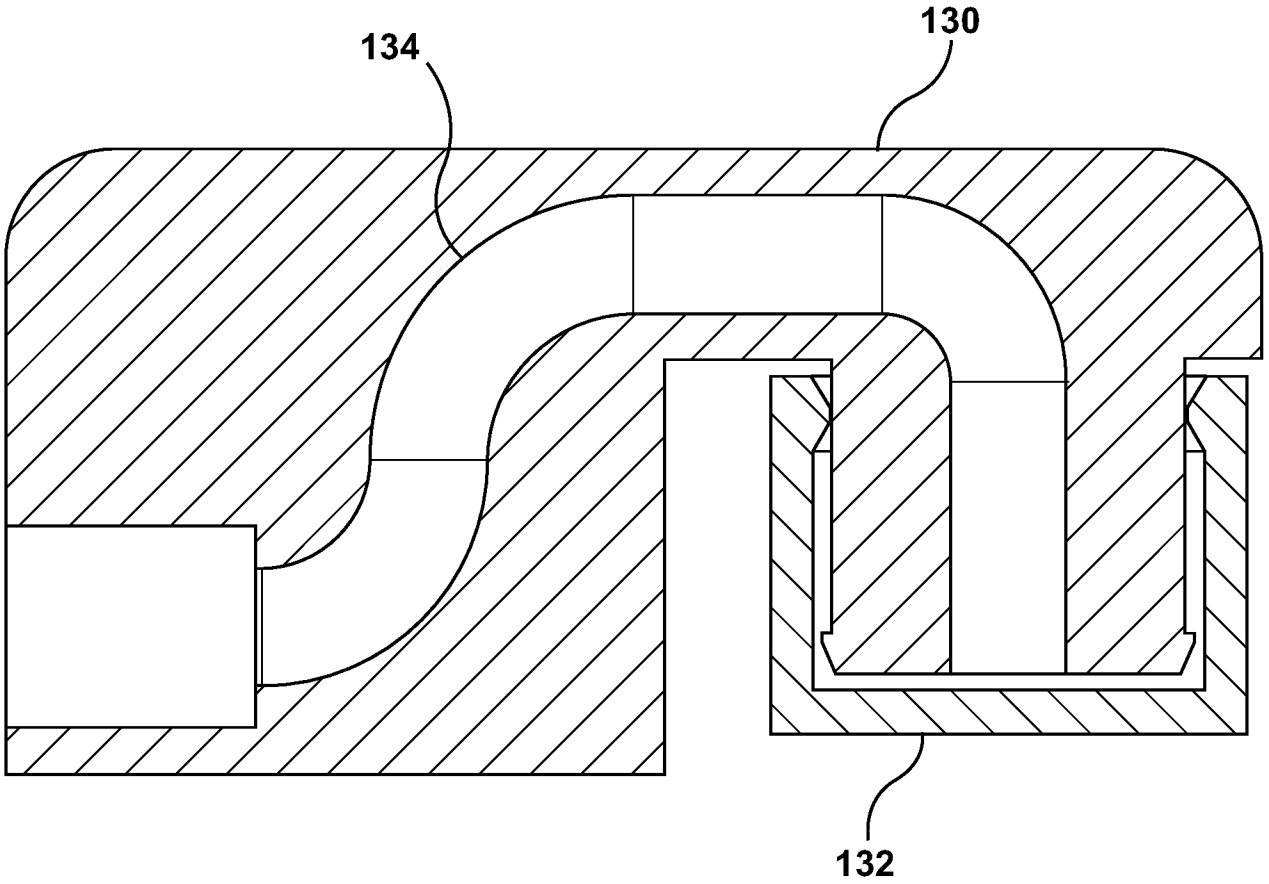
FIG. 11 is a transparent side elevation view of the actuated block of the pneumatic remote actuating device of FIG. 9.

FIG. 9 is a perspective view of an actuated block of the pneumatic remote actuating device according to another embodiment. FIG. 10 is a transparent perspective view of the actuated block of the pneumatic remote actuating device of FIG. 9. FIG. 11 is a transparent side elevation view of the actuated block of the pneumatic remote actuating device of FIG. 9. As seen on FIGS. 9-11, the channel 134 may have various shapes and may have an enlarged port for ease of connection of the tube 120. In contrast with FIGS. 5-8 in which a major part of the pusher 132 is internal to the actuated block 132, the pusher 132 of FIGS. 9-11 is for the most part external to the actuated block.

As in the case of pushbutton 114 and the actuator block 110, various arrangements (not shown) are provided to ensure that the pusher 132 is not dislodged from the actuated block 130 when not in use or when in the resting position.

Figure 12:
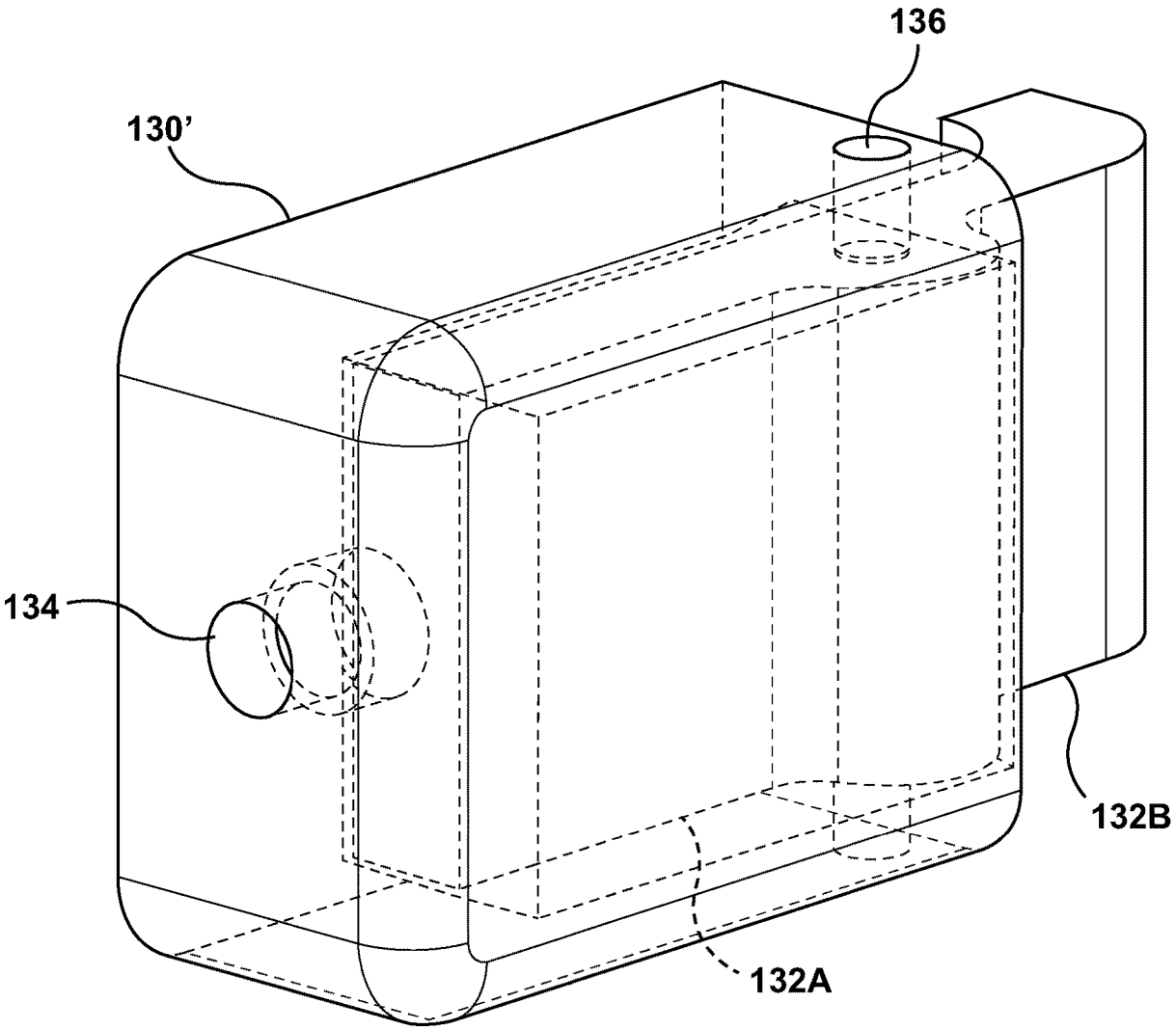
FIG. 12 is a front perspective view of an actuated block having a pivoting pusher according to an embodiment.
Figure 13:
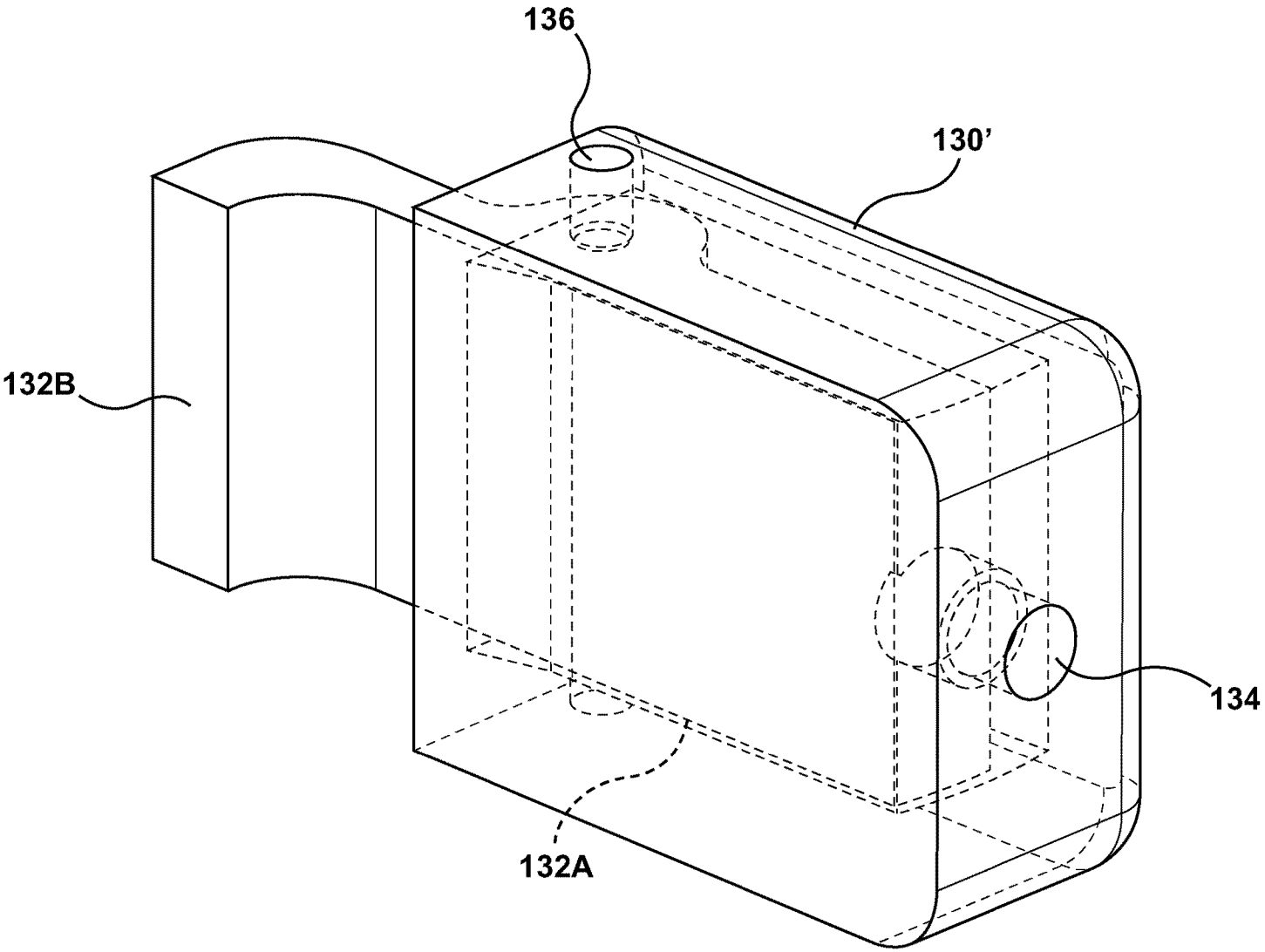
FIG. 13 is a rear perspective view of the actuated block having a pivoting pusher of FIG. 13.
Figure 14:
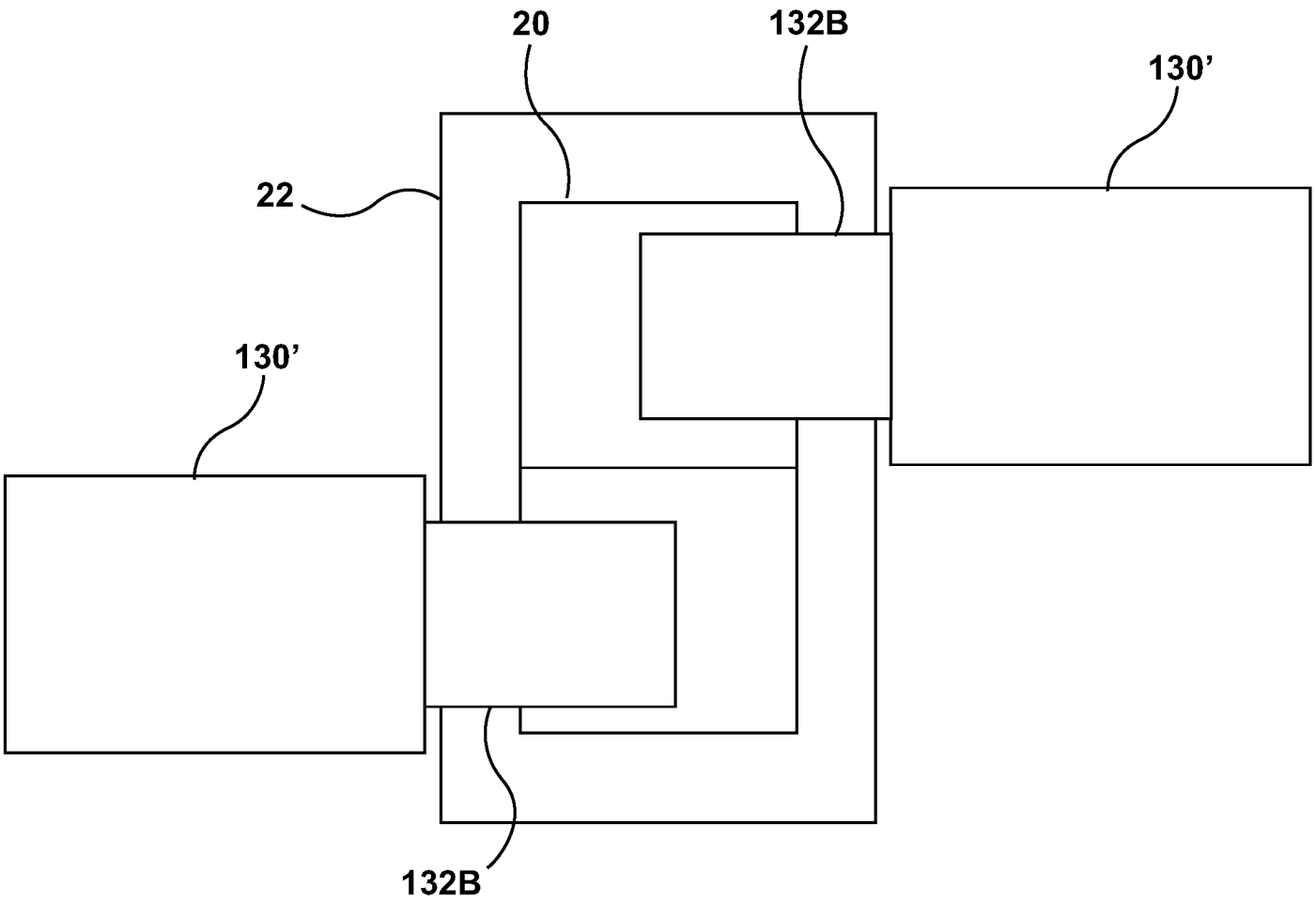
FIG. 14 is a front elevation view of a rocker switch and of two actuated block having pivoting pushers.

FIG. 12 is a front perspective view of an actuated block having a pivoting pusher according to an embodiment. FIG. 13 is a rear perspective view of the actuated block having a pivoting pusher of FIG. 13. FIG. 14 is a front elevation view of a rocker switch and of two actuated blocks having pivoting pushers. Referring to FIGS. 12 and 13, an actuated block 130' may be used in connection with the actuator block 110 and the tube 120 as described hereinabove. A pusher has a rear end 132A and a front end 1326, the pushed being mounted on a pivot 136. Application of a pressure in the channel 134 causes the pusher to rotate about the pivot 136, resulting in a displacement of the front end 132B of the pusher. The front end 132B of the pusher may then press on a first end of a rocker switch 20, causing the rocker switch 20 to move from a first position to a second position. In many instances, the rocker switch 20 is not biased to return to its first position when the pressure is released on its first end. As shown in FIG. 14, a pair of pneumatic remote actuating devices 100 may be used to control the rocker switch 20 supported by a mounting plate 22. A front end 1326 of a first actuated block 130' may be used to press on the first end of the rocker switch 20, moving the rocker switch 20 from its first position to its second position, for example to turn on a light. A front end 132B of a second actuated block 130' may be used to press on a second end of the rocker switch 20, moving the rocker switch 20 from its second position to its first position, for example to turn off the light.

Figure 15:
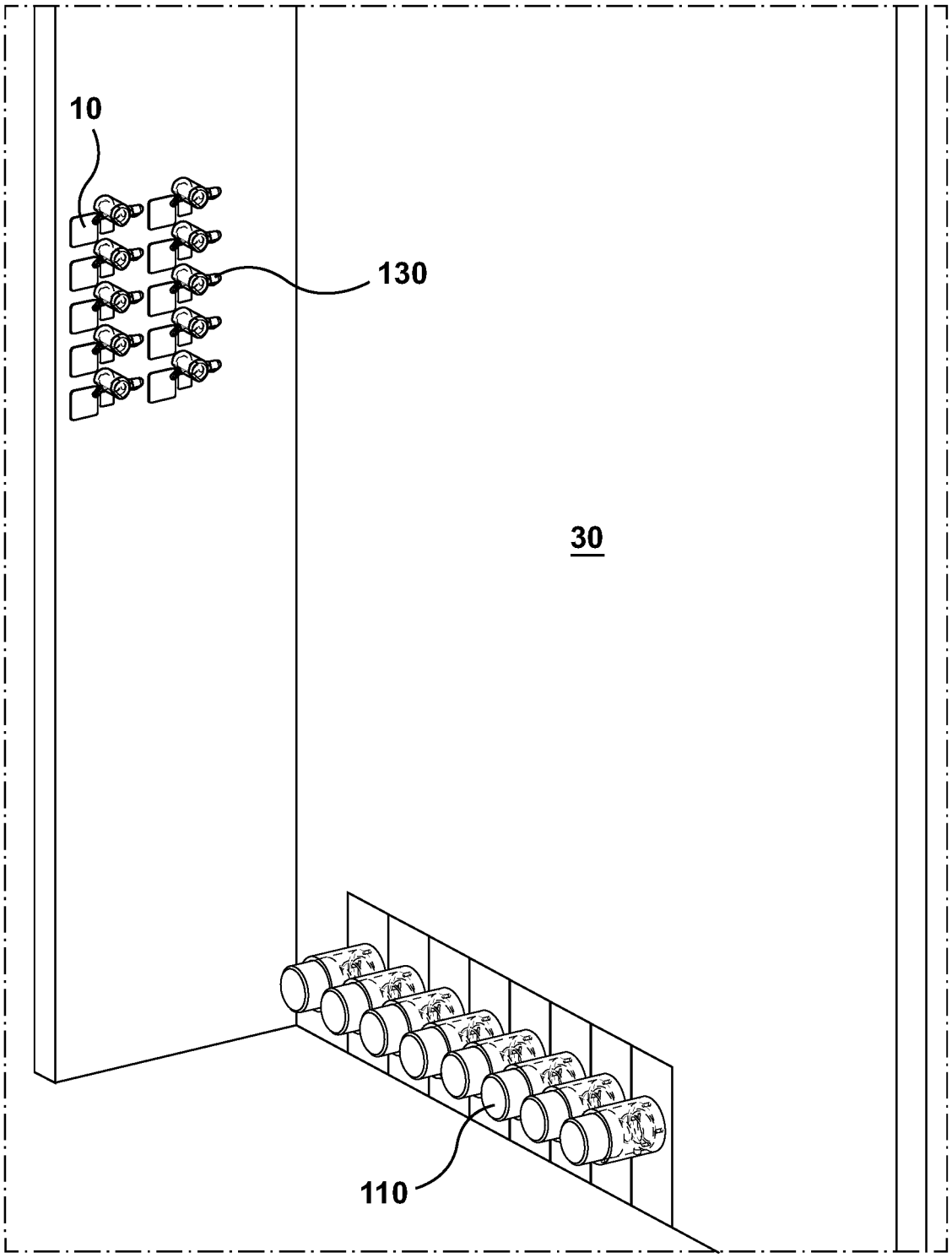
FIG. 15 is a perspective view of an assembly comprising a plurality of pneumatic remote actuating devices installed in an elevator according to an embodiment.
Figure 16:
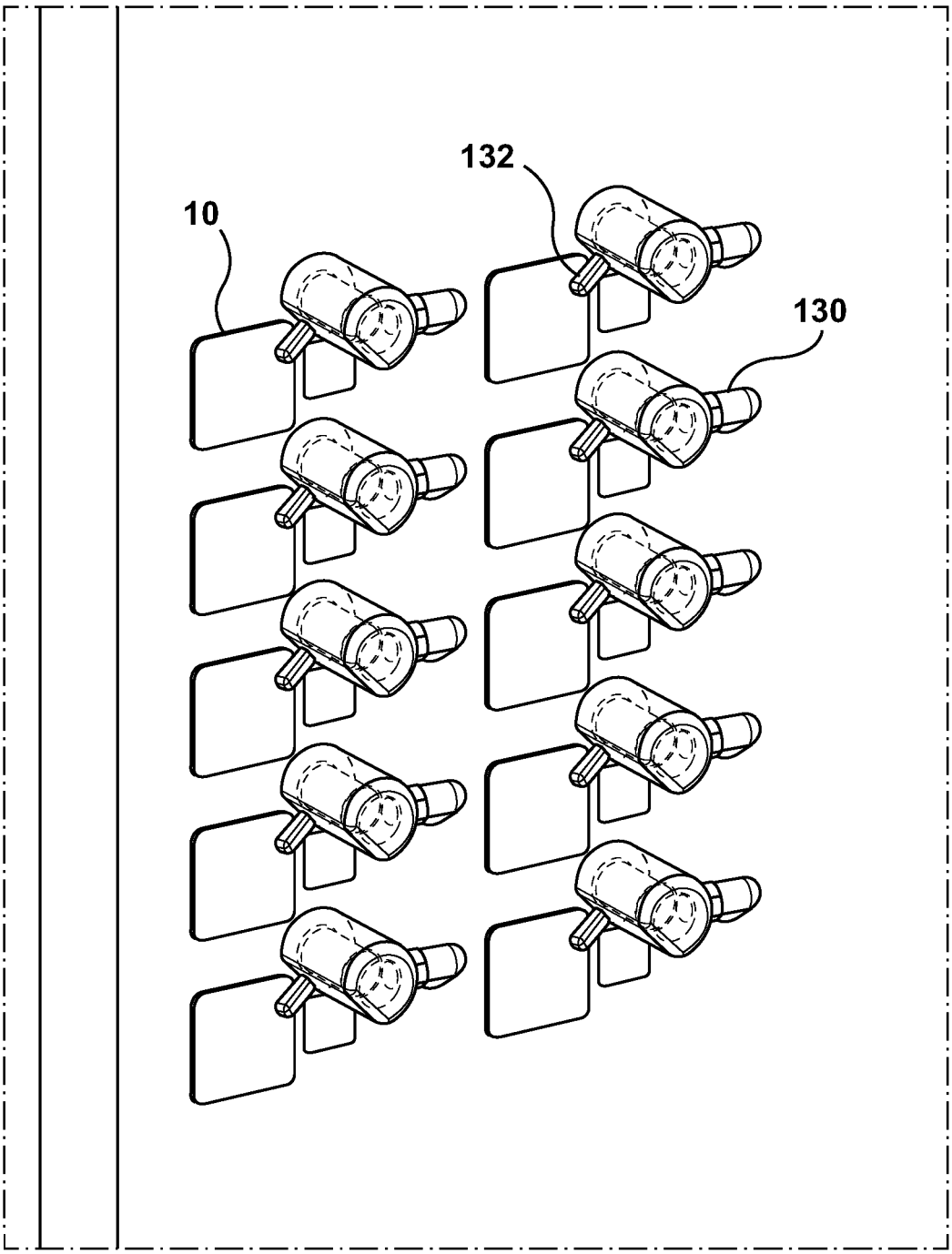
FIG. 16 is a perspective detailed view of an upper part of the assembly of FIG. 15.
Figure 17:
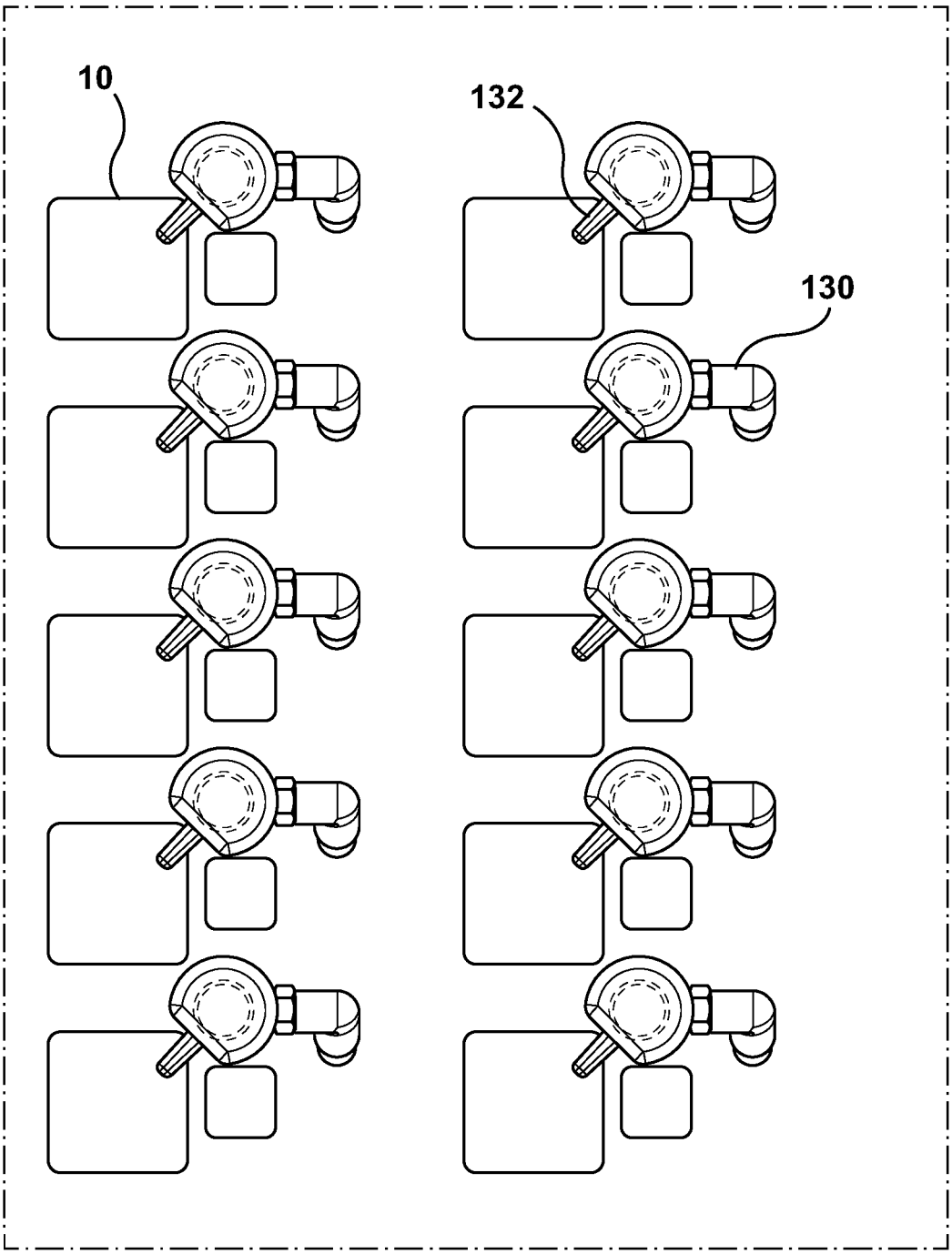
FIG. 17 is a front elevation detailed view of the upper part of the assembly of FIG. 15.
Figure 18:
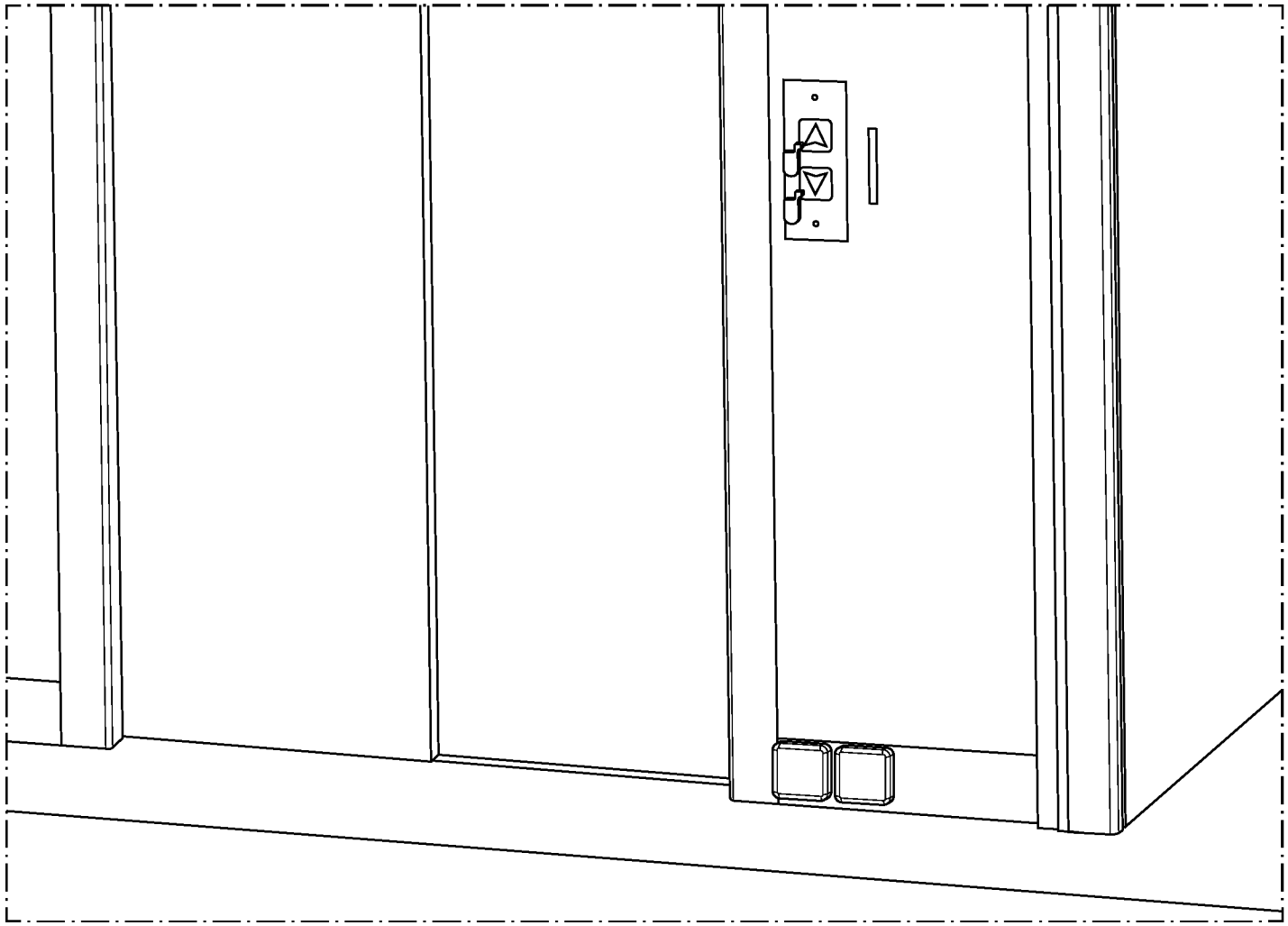
FIG. 18 is a perspective, external view of an elevator door showing two pneumatic remote actuating devices usable to call the elevator for moving up or down between floors.
Figure 19:
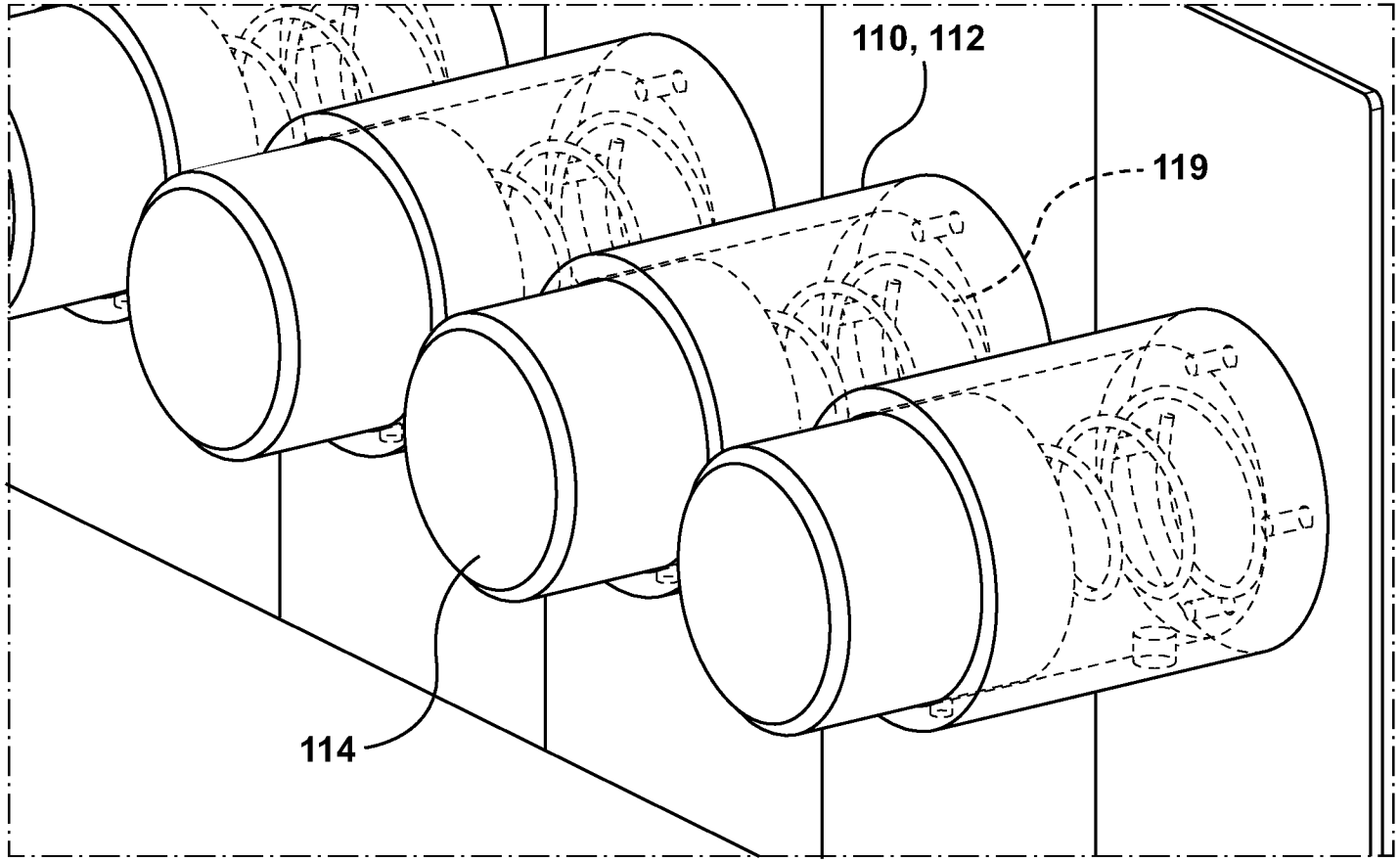
FIG. 19 is a perspective detailed view of a lower part of the assembly of FIG. 15.

FIG. 15 is a perspective view of an assembly comprising a plurality of pneumatic remote actuating devices installed in an elevator according to an embodiment. FIG. 16 is a perspective detailed view of an upper part of the assembly of FIG. 15. FIG. 17 is a front elevation detailed view of the upper part of the assembly of FIG. 15. FIG. 18 is a perspective, external view of an elevator door showing two pneumatic remote actuating devices usable to call the elevator for moving up or down between floors. FIG. 19 is a perspective detailed view of a lower part of the assembly of FIG. 15. A plurality of external pushbuttons 10 is installed inside an elevator 30. A corresponding plurality of pneumatic remote actuating devices 100 is installed in the elevator 30, without necessitating any modification to the electronics controlled by these external pushbuttons. Actuator blocks 110 may be mounted on a wall of the elevator 30—they could alternatively be mounted on the floor, which would however be less convenient when cleaning the floor of the elevator. Each actuator block 110 is connected via a corresponding tube (not shown) to an actuated block 130 positioned near a corresponding external pushbutton 10. In the illustrated embodiment, pushers 132 are positioned to depress on their respective external pushbuttons while allowing sufficient space on the surface of the external pushbuttons 10 to allow users to operate them with fingers in the conventional manner. The pneumatic remote actuating devices 100 may thus be installed both inside the elevator 30, as show on FIG. 15, and on each floor where the elevator 30 may have external doors, as shown on FIG. 18.

As shown on FIG. 19, in an embodiment, a coil spring 119 may be mounted in the internal chamber 118 formed in the enclosure 112 of the actuator block 110. The coil spring 119 is compressed when the pushbutton 114 is moved inward of the internal chamber 118. When external pressure is released on the pushbutton 114, the coil spring 119 distends and causes the pushbutton 114 to return to its resting position.

Figure 20A:
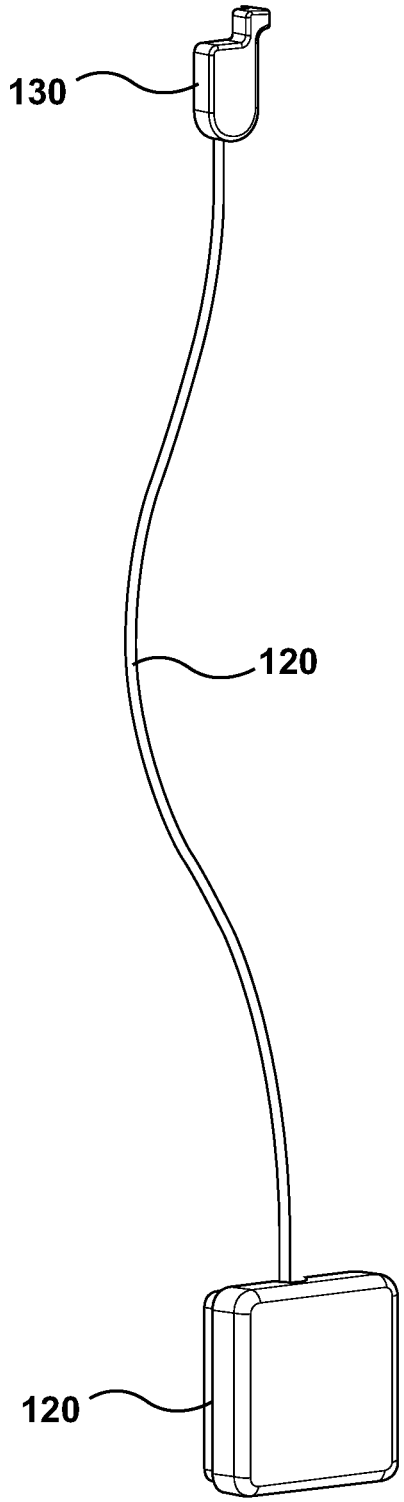
FIG. 20A is front perspective view of a pneumatic remote actuating device according to an embodiment.
Figure 20B:
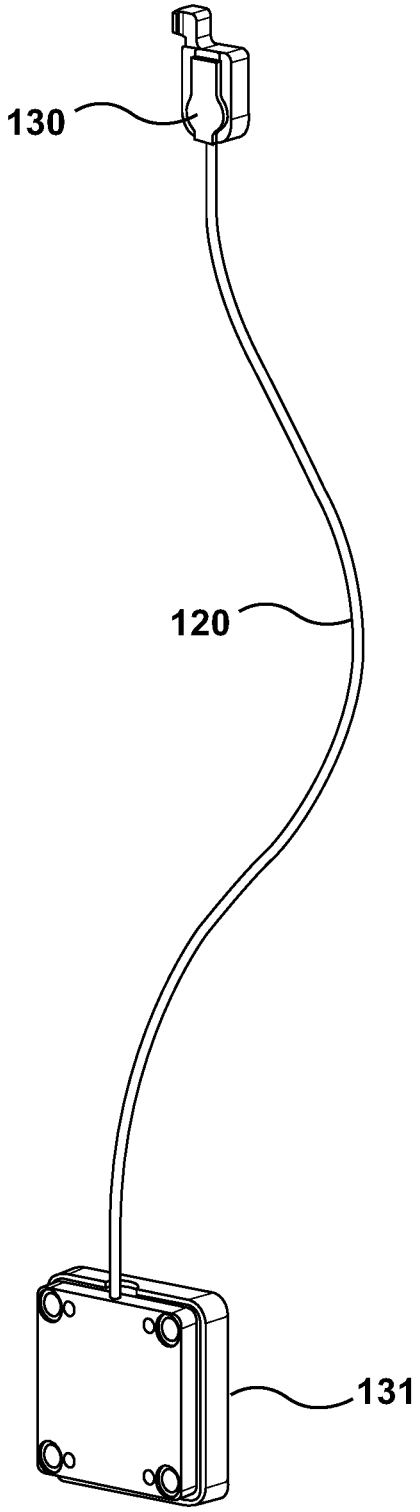
FIG. 20B is a rear perspective view of the pneumatic remote actuating device of FIG. 20A.

FIG. 20A is front perspective view of a pneumatic remote actuating device according to an embodiment. FIG. 20B is a rear perspective view of the pneumatic remote actuating device of FIG. 20A. The shown pneumatic remove actuating device includes variants of the above-description actuator block and actuated block that are described in more details in connection with the following Figures.

Figure 21C:
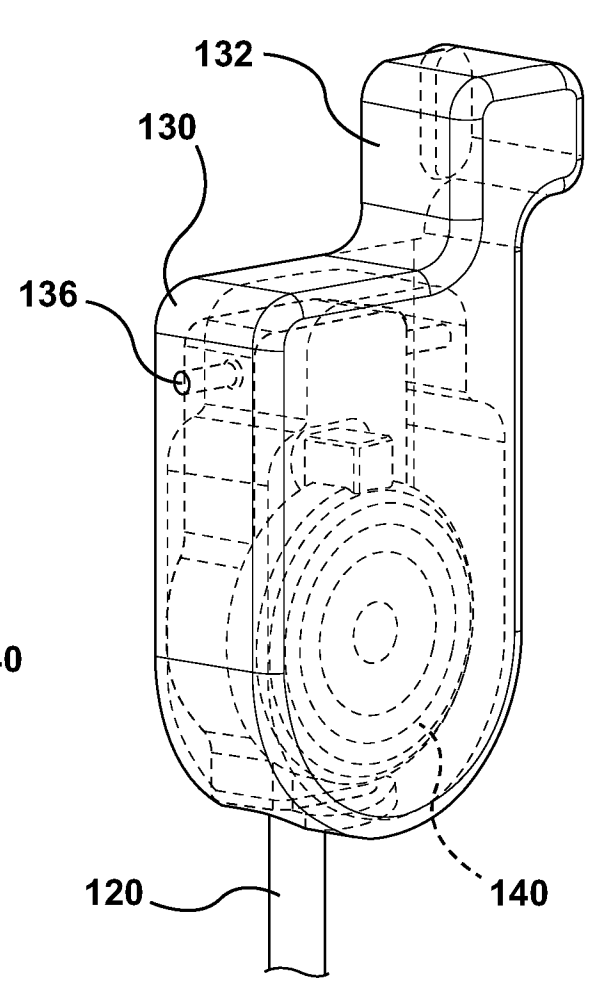
FIG. 21C is a perspective, transparent view of the actuated block of FIG. 21A.
Figure 21B:
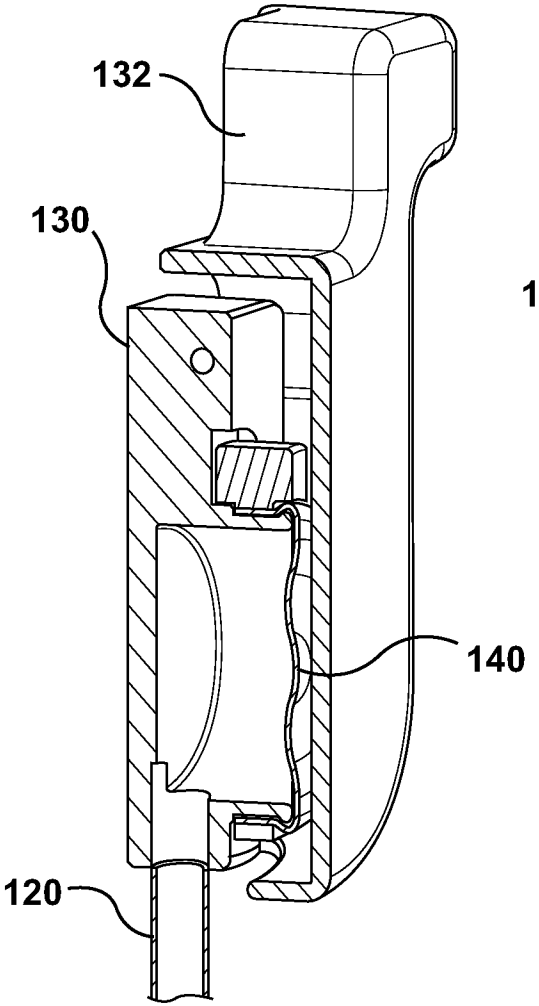
FIG. 21B is a perspective, cross-sectional view of the actuated block of FIG. 21A.
Figure 21A:
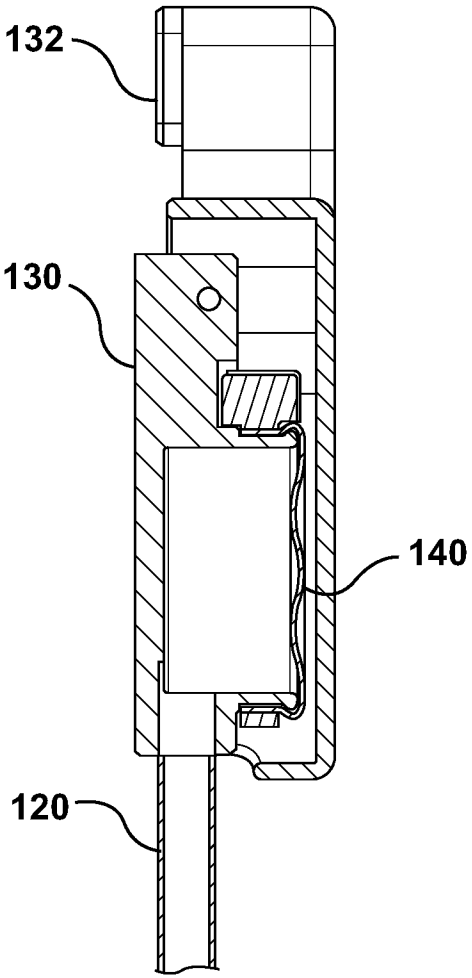
FIG. 21A is a side cross-sectional view of an actuated block according to an embodiment.

FIG. 21A is a side cross-sectional view of an actuated block according to an embodiment. FIG. 21B is a perspective, cross-sectional view of the actuated block of FIG. 21A. FIG. 21C is a perspective, transparent view of the actuated block of FIG. 21A. The actuated block of FIG. 21A-C differs from the previous actuated blocks 130 in two main aspects. In a first aspect, the actuated block contains a diaphragm 140 that reacts to a variation of air pressure in the tube that connects the actuated block to an actuator block. The variation of air pressure causes a deflection of the diaphragm 140. In turn, the deflection of the diaphragm 140 causes a movement of pusher. In a second aspect, while the pusher is still pivotably mounted to an enclosure of the actuated device of the actuated block, major parts the pusher are external to the enclosure of the actuated device.

Figure 22C:
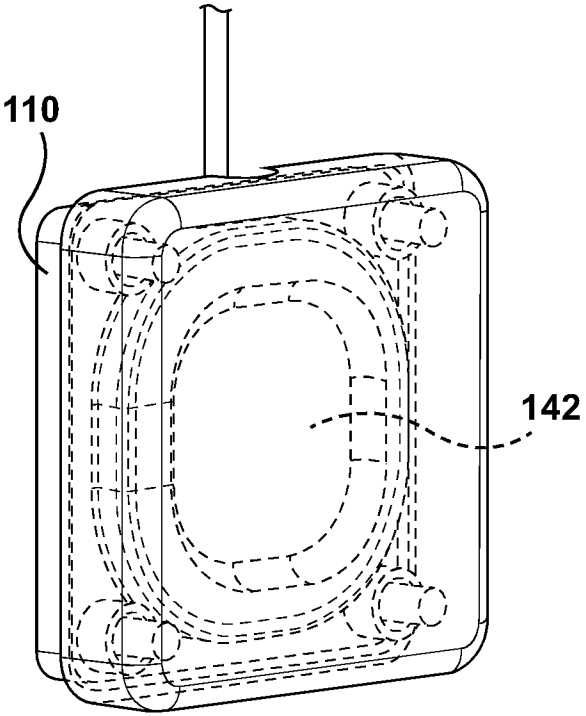
FIG. 22C is a perspective, transparent view of the actuator block of FIG. 22A.
Figure 22B:
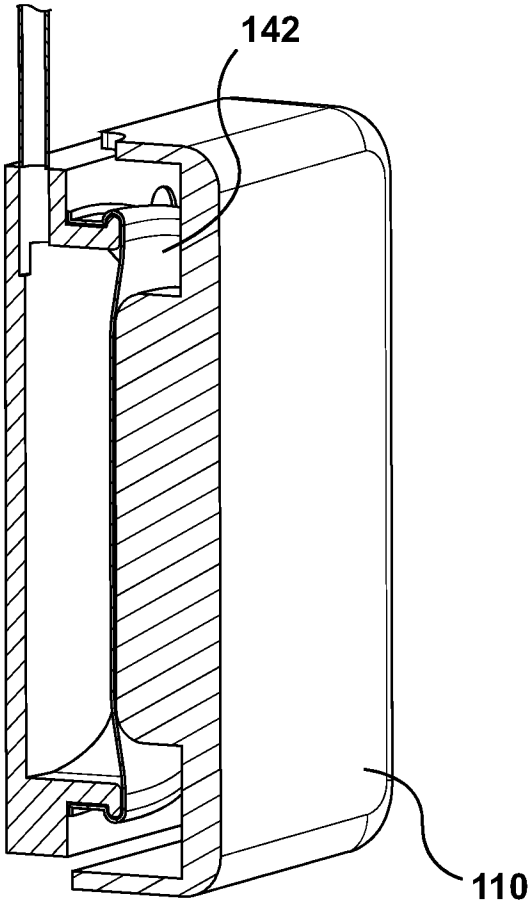
FIG. 22B is a perspective, cross-sectional view of the actuator block of FIG. 22A.
Figure 22A:
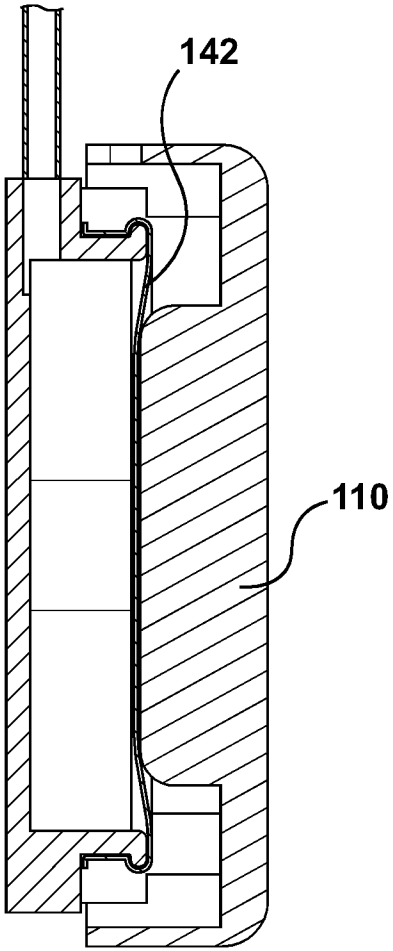
FIG. 22A is a side cross-sectional view of an actuator block according to an embodiment.

FIG. 22A is a side cross-sectional view of an actuator block according to an embodiment. FIG. 22B is a perspective, cross-sectional view of the actuator block of FIG. 22A. FIG. 22C is a perspective, transparent view of the actuator block of FIG. 22A. As in the case of the actuated block of FIGS. 21A-C, the actuator block of FIGS. 22A-C comprises a diaphragm 142 mounted to its enclosure and resting on a pushbutton. Depressing the pushbutton causes a displacement of the diaphragm 142, which in turn causes a variation of air pressure in the enclosure of the actuator block. This variation of air pressure is transmitted to the actuated block via the tube. In a non-limiting embodiment, use of the actuator block of FIGS. 22A-C with the actuated block of FIGS. 21A-C allows the pneumatic remote actuating device to be essentially leak-free. The actuator block of FIGS. 22A-C and the actuated block 21A-C may alternatively be used with components illustrated in earlier Figures of the present disclosure.

Figure 23C:
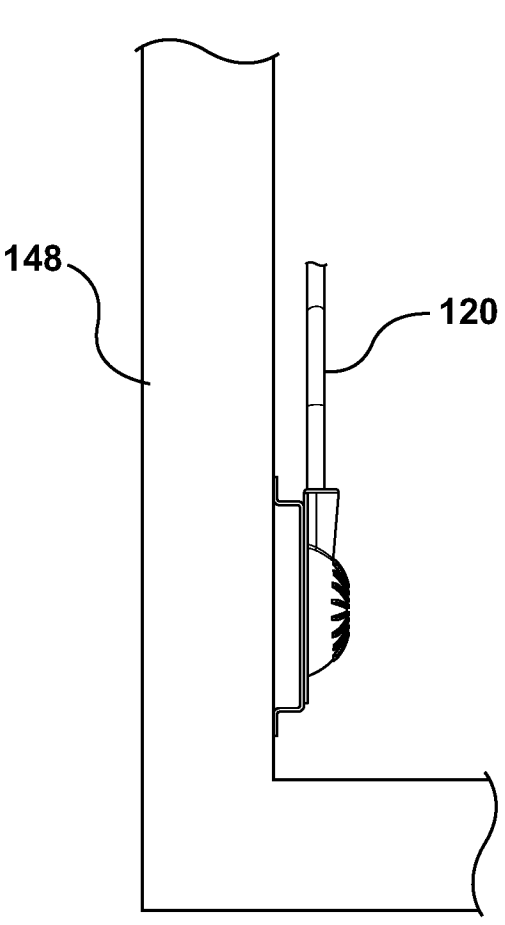
FIG. 23C is a side elevation view of the actuator block of FIG. 23A mounted on a receiving surface.
Figure 23B:
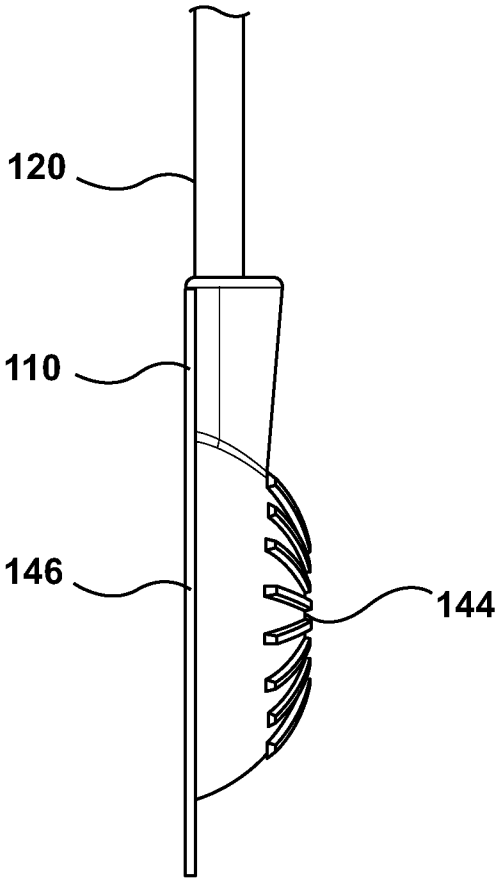
FIG. 23B is a side elevation view of the actuator block of FIG. 23A.
Figure 23A:
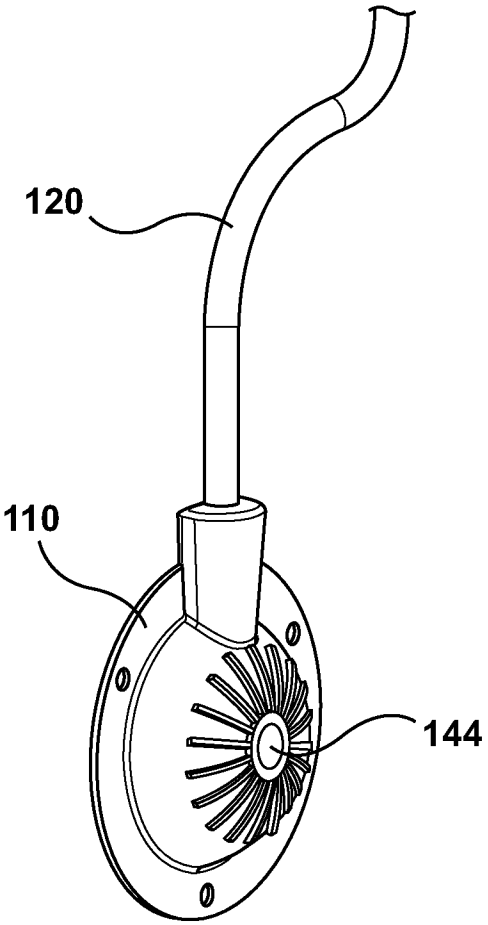
FIG. 23A is a side perspective view of an actuator block according to an embodiment.

FIG. 23A is a side perspective view of an actuator block according to an embodiment. FIG. 23B is a side elevation view of the actuator block of FIG. 23A. FIG. 23C is a side elevation view of the actuator block of FIG. 23A mounted on a receiving surface. The actuator block of FIGS. 23A-C includes a deformable front external face 144 and a rear external face 146 that may be mounted on a receiving structure 148. A compressible inner chamber is formed between the front and rear external faces 144 and 146. When a pressure is applied on the deformable front external face 144, the inner chamber becomes compressed and cause an air pressure to be applied on the tube for causing a movement of the actuated block.

Figure 24:
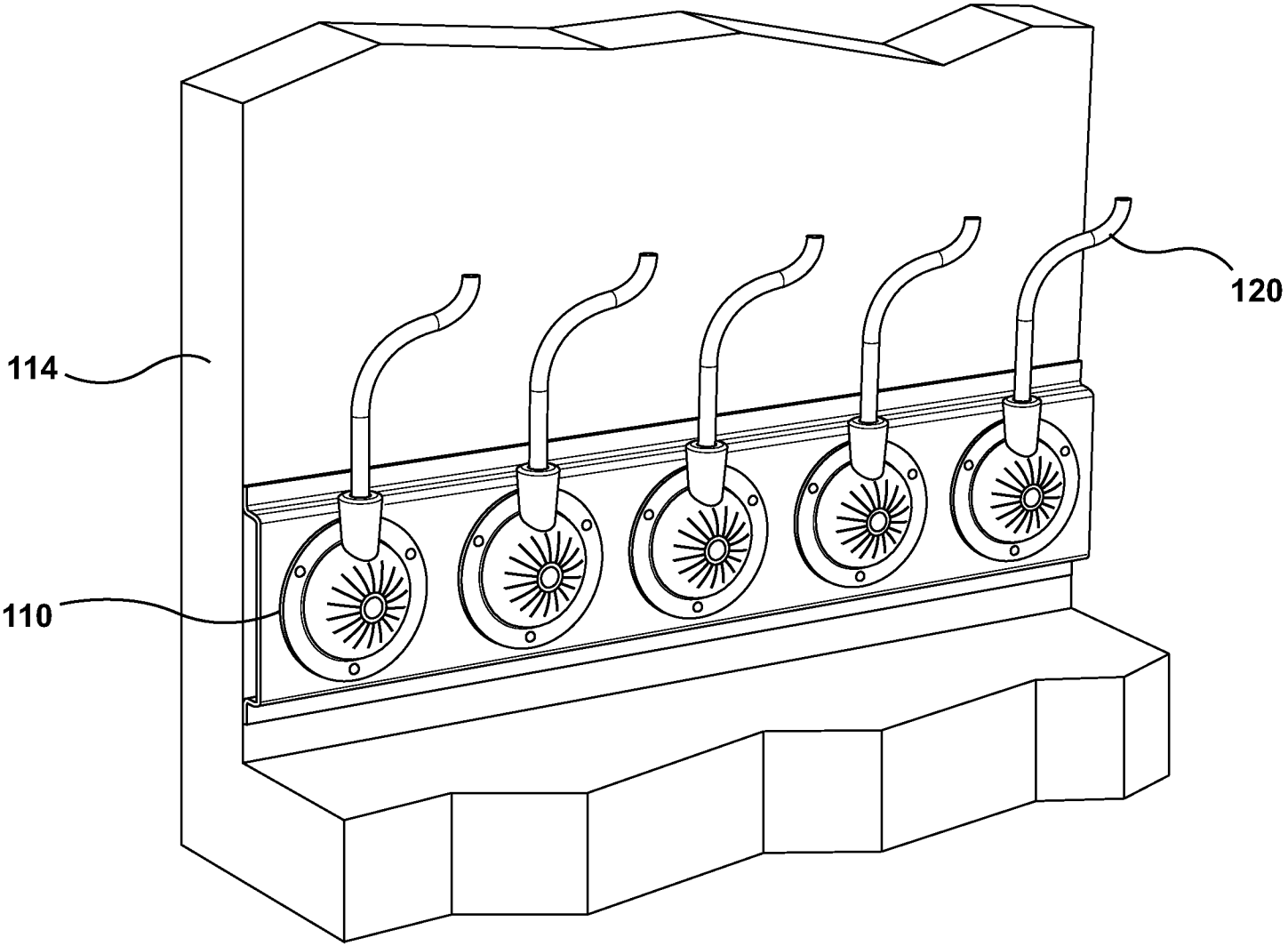
FIG. 24 is a perspective view of an assembly comprising a plurality of actuator blocks of FIG. 23A.

FIG. 24 is a perspective view of an assembly comprising a plurality of actuator blocks of FIG. 23A. A number of actuator blocks are assembled for use with a plurality of corresponding actuated blocks, for example and without limitation to control an elevator.

Various mechanical devices having one or more external pushbuttons may be controlled in the same or equivalent manner.

Those of ordinary skill in the art will realize that the description of the pneumatic remote actuating device are illustrative only and are not intended to be in any way limiting. Other embodiments will readily suggest themselves to such persons with ordinary skill in the art having the benefit of the present disclosure. Furthermore, the disclosed pneumatic remote actuating device may be customized to offer valuable solutions to existing needs and problems the lack of hygiene of conventional actuating devices and to the difficulties in retrofitting existing equipment with electronic remote controls. In the interest of clarity, not all of the routine features of the implementations of the pneumatic remote actuating device are shown and described. In particular, combinations of features are not limited to those presented in the foregoing description as combinations of elements listed in the appended claims form an integral part of the present disclosure. It will, of course, be appreciated that in the development of any such actual implementation of the pneumatic remote actuating device, numerous implementation-specific decisions may need to be made in order to achieve the developer's specific goals, such as compliance with application-related, system-related, and business-related constraints, and that these specific goals will vary from one implementation to another and from one developer to another. Moreover, it will be appreciated that a development effort might be complex and time-consuming, but would nevertheless be a routine undertaking of engineering for those of ordinary skill in the field of actuating devices having the benefit of the present disclosure.

The present disclosure has been described in the foregoing specification by means of non-restrictive illustrative embodiments provided as examples. These illustrative embodiments may be modified at will. The scope of the claims should not be limited by the embodiments set forth in the examples, but should be given the broadest interpretation consistent with the description as a whole.

What is claimed is:

1. A method for controlling an elevator, comprising:

a) providing an array of actuator blocks, each actuator block comprising:

a first enclosure defining a first compressible internal chamber, compressing the first compressible internal chamber causing an air pressure variation in the first internal chamber; and b) providing a plurality of actuated blocks, each actuated block, comprising:

a second enclosure defining a second internal chamber, and a pusher mounted to the second enclosure, an air pressure variation in the second internal chamber causing a displacement of the pusher;

c) mounting each actuated block proximally to a corresponding elevator button so that the pusher is positioned to depress the corresponding elevator button when displaced;

d) mounting the array of actuator blocks in an area of the elevator remote from the elevator buttons;

e) connecting each actuator block of the array of actuator blocks to a corresponding actuated block via a corresponding tube so that, for each combination of a given actuator block with a given tube and a given actuated block:

the given tube fluidly connects the first compressible internal chamber of the given actuator block to the second internal chamber of the given actuated block, and the air pressure variation of the first compressible internal chamber of the given actuator block is transmissible via the given tube to the second internal chamber of the given actuated block; and f) after a) to e) depressing a selected one of the actuator blocks to cause a displacement of the pusher of the corresponding actuated block and to cause depressing a selected elevator button.

2. The method of claim 1, wherein the area of the elevator remote from the elevator buttons is at a bottom of a wall of the elevator.

3. The method of claim 2, wherein the actuator blocks of the array are configured to be foot-operated.

4. The method of claim 1, further comprising:

mounting an additional pair of actuator blocks on a wall outside of an elevator door; and mounting a corresponding additional pair of actuated blocks fluidly connected to the actuator blocks of the additional pair, each actuated block of the additional pair being positioned for depressing a corresponding one of a pair of elevator call buttons when receiving pressure from the corresponding actuator block of the additional pair.

5. The method of claim 4, comprising mounting one additional pair of actuator blocks and one corresponding additional pair of actuated block on each floor serviced by the elevator.

6. The method of claim 1, wherein:

each actuator block further comprises a pushbutton slidably mounted to the first enclosure; and in each actuator block, an inward movement of the pushbutton from a resting position to an activated position into the first enclosure compresses the first compressible internal chamber and causes the air pressure variation in the first internal chamber.

7. The method of claim 6, wherein each actuator block includes a leak allowing a reduction of the air pressure variation when the pushbutton returns to the resting position.

8. The method of claim 6, wherein each actuated block includes a leak allowing a reduction of the air pressure variation when the pushbutton returns to the resting position.

9. The method of claim 1, wherein connecting each actuator block of the array of actuator blocks to a corresponding actuated block via a corresponding tube comprises using a flexible tube.

10. The method of claim 1, wherein connecting each actuator block of the array of actuator blocks to a corresponding actuated block via a corresponding tube comprises using a rigid tube.

11. The method of claim 1, wherein the second enclosure of each actuated block includes a generally flat rear face adapted to be bonded to a receiving surface proximate to the elevator buttons.

12. The method of claim 1, wherein the first enclosure of each actuator block includes a generally flat rear face adapted to be bonded to a wall of the elevator.

13. The method of claim 1, wherein the activated block comprises a pivot, the pusher being supported by the pivot, the displacement of the pusher being obtained when the air pressure variation transmitted by the tube to the second internal chamber causing pivoting of the pusher.

14. The method of claim 1, wherein the air pressure variation is a variation in relation to an ambient atmospheric pressure.

15. The method of claim 1, wherein the air pressure variation is an increase of air pressure.

16. The method of claim 1, wherein the air pressure variation is a decrease of air pressure.

* * * * *